US009959696B2

(12) United States Patent
Szpak et al.

(10) Patent No.: US 9,959,696 B2
(45) Date of Patent: May 1, 2018

(54) RESILIENTLY BIASED ACTUATOR

(71) Applicant: Fasteners For Retail, Inc., Twinsburg, OH (US)

(72) Inventors: Gerald Matthew Szpak, Brecksville, OH (US); Thaddeus Brej, Rocky River, OH (US); Shane Obitts, Elyria, OH (US); Gregory M. Bird, Solon, OH (US)

(73) Assignee: Fastners for Retail, Inc., Twinsburg, OH (US)

( * ) Notice: Subject to any disclaimer, the term of this patent is extended or adjusted under 35 U.S.C. 154(b) by 0 days. days.

(21) Appl. No.: 14/744,698

(22) Filed: Jun. 19, 2015

(65) Prior Publication Data

US 2015/0371482 A1 Dec. 24, 2015

Related U.S. Application Data

(60) Provisional application No. 62/014,476, filed on Jun. 19, 2014.

(51) Int. Cl.
*G07F 11/00* (2006.01)
*A47F 1/12* (2006.01)

(52) U.S. Cl.
CPC ..... *G07F 11/005* (2013.01); *A47F 1/125* (2013.01)

(58) Field of Classification Search
CPC ..... B65D 1/00
See application file for complete search history.

(56) References Cited

U.S. PATENT DOCUMENTS 2,784,871 A 3/1957 Gabrielsen
3,146,907 A * 9/1964 Bookout ..... A47F 1/10 194/351
3,262,603 A 7/1966 Schendorf et al.
3,282,126 A 11/1966 Dykinga et al.
3,730,409 A * 5/1973 Ratti ..... A47K 10/36 225/10
3,792,207 A 2/1974 Muhling et al.
4,363,393 A 12/1982 McDonald
(Continued)

FOREIGN PATENT DOCUMENTS

GB 2 386 116 A 9/2003

OTHER PUBLICATIONS

FFR-DSI Total Retail Solutions 2013 Yellow Pages Product Catalog, cover page and page 338.

*Primary Examiner* — Gene Crawford
*Assistant Examiner* — Ayodeji Ojofeitimi
(74) *Attorney, Agent, or Firm* — Honigman Miller Schwartz and Cohn LLP

(57) ABSTRACT

A dispenser which deters theft of packaged items includes an ejector. The ejector is resiliently biased to an extended position, and is selectively retracted to a retracted position. When so retracted, it can be released so that it can translate a static package into a dynamic state as quickly as possible to minimize the effect of drag and friction between the package being ejected and the package immediately behind it in a column of packages, as well as between the package and the portions of the housing which are initially contacted by the package. The first package is ejected in a short impulse so as to minimize a transfer of kinetic energy to a second package, thus minimizing the effect of static inertia of the second package on the first package.

23 Claims, 18 Drawing Sheets

(56) References Cited

U.S. PATENT DOCUMENTS 4,711,369 A 12/1987 Duchin
4,887,737 A * 12/1989 Adenau ..... A47F 1/126 221/192
5,133,478 A 7/1992 Gordon
5,178,298 A * 1/1993 Allina ..... B65D 83/0418 206/457
5,191,995 A * 3/1993 McDonald ..... A63B 47/002 221/227
5,238,144 A 8/1993 Kornegay
5,605,249 A 2/1997 Gonyea
5,665,304 A 9/1997 Heinen et al.
5,782,377 A * 7/1998 Fassman ..... B65G 59/067 221/115
5,857,588 A 1/1999 Kasper
6,247,611 B1 6/2001 Clements et al.
6,264,060 B1 7/2001 Podgorny et al.
6,478,187 B2 11/2002 Simson et al.
6,604,652 B1 8/2003 Trautwein
6,811,053 B2 11/2004 Schwarzli
7,424,957 B1 * 9/2008 Luberto ..... A47F 1/126 211/59.3
7,828,158 B2 11/2010 Colelli et al.
8,413,843 B2 4/2013 Vardaro
8,485,391 B2 * 7/2013 Vlastakis ..... A47F 1/126 211/184
8,662,320 B2 3/2014 Csak
2004/0060944 A1 4/2004 Gervasi
2005/0189369 A1 * 9/2005 Vlastakis ..... A47F 1/126 221/123
2006/0180603 A1 8/2006 Eckert
2007/0084875 A1 * 4/2007 Percy ..... G07F 11/16 221/258
2008/0245811 A1 * 10/2008 Colelli ..... G07F 9/02 221/90
2011/0130782 A1 6/2011 Kan et al.
2012/0055892 A1 3/2012 Hardy
2012/0067917 A1 3/2012 Obitts et al.
2014/0034592 A1 2/2014 Hardy
2014/0177818 A1 5/2014 Dipaolo et al.
2014/0190913 A1 7/2014 Hardy et al.
2015/0096997 A1 4/2015 Obitts et al.

* cited by examiner

FIG. 13
(PRIOR ART)
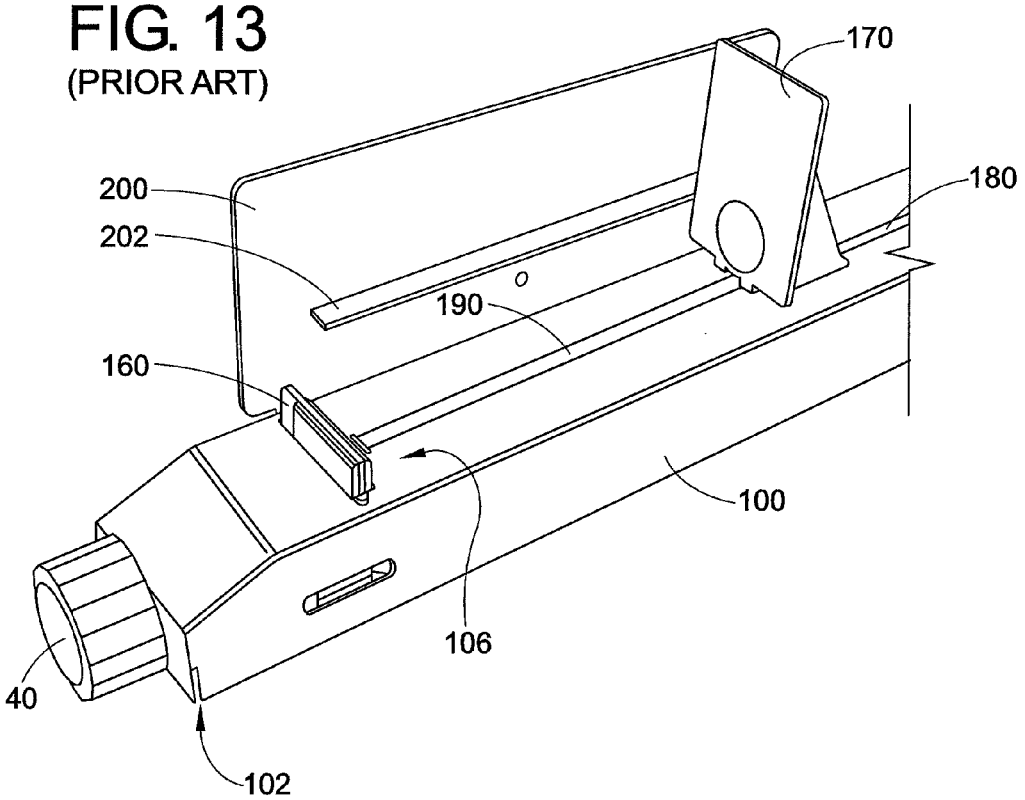
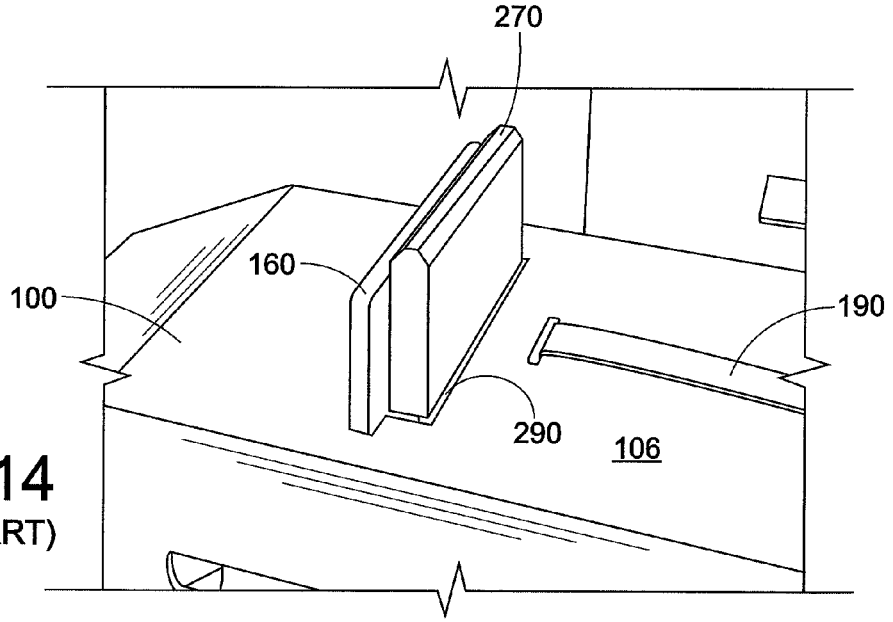
FIG. 14
(PRIOR ART)

RESILIENTLY BIASED ACTUATOR

This application claims the benefit of Provisional Application Ser. No. 62/014,476 which was filed on Jun. 19, 2014. The entire content of that application is incorporated hereinto by reference.

BACKGROUND

The present disclosure pertains to merchandise dispensing devices for retail venues where theft of merchandise which is displayed on open shelves is a concern. More particularly, the present disclosure relates to a dispensing device which allows single products to be accessed but prevents multiple products from being removed from the dispensing device at the same time. Even more particularly, the present disclosure pertains to a resiliently biased actuator which selectively engages a single product and makes that product available for removal from the dispensing device.

BRIEF DESCRIPTION

Recently, retail stores which traditionally display products on open shelves have experienced product theft. Items which are in high demand by thieves include cough and cold medications, razor blades, cameras, printer ink cartridges, batteries, dvds, smoking and smoking cessation articles, fragrances, infant formula and the like. Shelf sweeping is a particular problem for small items. Such sweeping occurs when one or more people remove all or most of the items displayed on a shelf into a bag or the like, and then exit the store. Shelf sweeping relies on the ability to quickly remove multiple items from the shelf at one time. In order to deter such sweeping, a merchant or retailer could only display a single item on the shelf. However, then the merchant must constantly restock the shelf, which would be very difficult to do. Therefore, merchants keep substantial inventory on a shelf making such inventory susceptible to theft.

Retailers are constantly challenged to balance the needs of legitimate consumer access to high theft items with measures to minimize the incidence of theft. Because theft has become so rampant in connection with certain product categories, for example razors and infant formula, many retail stores are now taking such products off of the shelf and placing them behind the counter or under lock and key. Customers must then request such items or products in order to make a purchase. However, such measures are disadvantageous as they add additional labor costs in order to provide individual service to customers who would not normally require it. Also, such merchandising techniques make it difficult for customers to compare products side by side. Moreover, it may be difficult to store multiple products behind a counter, as counter space is limited and may be needed for other items, such as prescription medications, expensive fragrances, or the like.

Product dispensing devices which deter theft, such as vending machines, are well known. They have been used for storing products of all sorts and for vending such products to customers in exchange for money, generally coins and/or currency, without vendor attention. However, the known vending machines are expensive to manufacture and operate and are not readily adapted for use in vending numerous types of products of varying sizes in a retail environment, such as a drug store or a grocery store. Known is a merchandise dispensing apparatus that provides theft deterrence and includes a box structure defined by a plurality of walls and a door allowing access to an interior space defined within the box structure. A plurality of pushers and dividers are employed to separate the merchandise held in the box structure into a set of columns of products. A rotatable knob is employed to select a forwardmost product or piece of merchandise in a column, separate it from the column and move it toward the door so that it can be accessed by a consumer.

One problem with this known design is that the effects of drag and friction between the product being purchased by a customer and the remaining products in the column will sometimes lead to two adjacent products being simultaneously separated from the column and moved towards the door for access by the consumer. When this happens, the merchant loses the value of the second item of merchandise, which is clearly disadvantageous for the merchant. Another problem which is sometimes encountered is that the effects of drag or friction between adjacent packages and/or between portions of the housing adjacent to the package being dispensed makes rotation of the knob difficult.

It would be desirable to provide a new and improved product dispensing system which accurately and readily dispenses exactly one item of merchandise in a housing that retards product theft and merchandise sweeping.

BRIEF SUMMARY

In accordance with one aspect of the present disclosure, an ejector mechanism is provided for moving an associated article away from a stack or column of such articles supported on a support surface. The ejector mechanism moves in a short impulse so as to minimize a transfer of kinetic energy to a second associated article, thus minimizing static inertia on the second associated article. The ejector mechanism comprises a selectively movable ejector element located adjacent the support surface with a surface of the ejector element being adapted for contacting a surface of the associated article. A biasing member contacts the ejector element and is adapted to bias the ejector element to a first end position in relation to the support surface. Also provided is an actuating member and an electromechanical or mechanical assembly operably connected to both the actuating member and the ejector element and adapted to selectively move the ejector element to a second end position against the bias of the biasing member.

According to another aspect of the present disclosure, an ejector mechanism is disclosed for ballistically moving an associated article away from a stack or column of such articles supported on a generally horizontally oriented surface located in a housing. The ejector mechanism comprises a selectively movable plate held in the housing with the plate including a surface adapted for contacting a surface of the associated article. A spring contacts the plate and is adapted to bias the plate to an extended position in relation to the surface. Also provided is an actuating member and an electromechanical or mechanical assembly operably connected to both the actuating member and the plate and adapted to selectively move the plate against the bias of the spring to a retracted position in relation to the surface.

In accordance with a yet further embodiment of the present disclosure, provided is a merchandise dispenser comprising a housing including a plurality of walls defining an interior space within the housing. At least one generally horizontally oriented merchandise support surface is located in the housing. An electromechanical ejector is located adjacent a front end of the at least one merchandise support surface. The ejector includes an electrical motor including an output shaft and an ejector plate movably mounted in relation to the housing at least one support surface. A gear train operably connects the output shaft of the motor to the ejector plate. A relay selectively provides electrical power to the motor. A spring urges the ejector plate into an extended position in relation to the at least one support surface so as to translate a static associated article into a dynamic state.

BRIEF DESCRIPTION OF THE DRAWINGS

FIG. 13 is an enlarged perspective view of a module of the known dispenser of FIG. 12;

FIG. 14 is an enlarged perspective view of a portion of the module of FIG. 13 in which an ejector plate is shown in a raised position;

DETAILED DESCRIPTION

Figure 12:
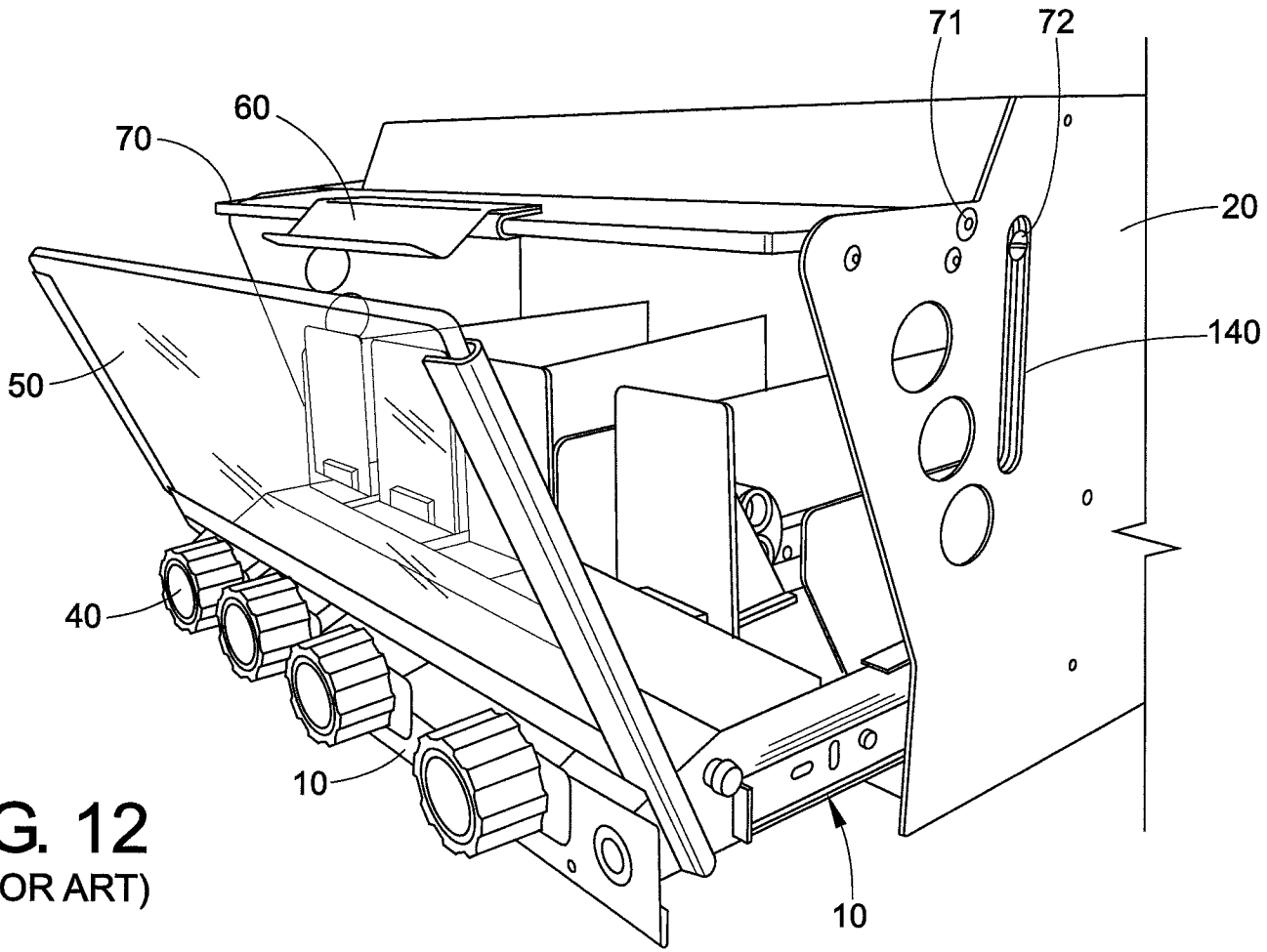
FIG. 12 (PRIOR ART)
FIG. 12 is a perspective view of a known theft deterrent merchandise dispenser.

With reference to FIG. 12, it is a perspective view of a dispenser according to U.S. Pat. No. 7,828,158, filed on Sep. 1, 2007 to Colelli et al. This patent is incorporated herein by reference in its entirety. The dispenser can be employed in a commercial setting such as a retail store to dispense merchandise generally in the form of packaged items. However, it is to be understood that the dispenser can be employed to dispense other types of products. The dispenser includes a box structure (only part of which is visible) having a plurality of walls enclosing and defining an interior space. The walls prevent access to the interior space from at least the front, sides, top, and bottom.

The dispenser includes a storage shelf 10 mounted in a wraparound enclosure 20. The enclosure 20 can be a sheet metal box open on its front and rear, but closed on its sides and top. The shelf 10 can close the bottom of the enclosure 20. The enclosure 20 may be mounted on wall standards as shown in U.S. Pat. No. 7,419,062, filed on Jan. 18, 2006 to Mason, which is incorporated herein by reference in its entirety. This advantageously prevents access to the interior space from the rear. Alternately, the dispenser may be placed on a shelf, or otherwise secured within a retail establishment in a manner that restricts access from the rear and prevents unauthorized persons from moving the dispenser. For example, the dispenser can be bolted in place.

In use, the shelf 10 is locked within the enclosure 20 so that packaged items mounted within the dispenser are only accessible via a controlled dispensing process. A packaged item can be dispensed by turning a knob 40 which dispenses a corresponding item or piece of merchandise to a forward position on the shelf 10 lying against a front glass plate 50. A handle 60 can then be raised thereby lifting a top glass plate 70 from a closed orientation or position into an open position. The top glass plate 70 is mounted via a first hinge 71. When the handle 60 and the top glass plate 70 are open, a customer's hand is able to reach into the dispenser from above to retrieve the dispensed item or piece of merchandise.

Simultaneous with the lifting of the top glass plate 70, a barrier strip (not shown) can be lowered. The barrier strip is engaged with the plate 70 via a second hinge so as to assume a vertical position blocking access to all but the front portion of the interior space accommodating the dispensed packaged item. Therefore, the barrier strip only allows access to the dispensed packaged item and provides a means of theft deterrence.

The top glass plate 70 pivots on hinges secured by a fastener 71 located on opposing sides of the enclosure 20. Also provided, on each side of the enclosure 20 are vertical slots 140 within which move screws 72 that control the attitude of the barrier strip. When the top glass plate is raised, the barrier strip is moved into a vertical position and the screws 72 are located at the bottom of the slots 140. Similarly, when the glass plate 70 is lowered it forces the barrier strip into a horizontal position where the screws 72 are located at the top of the slots 140. This is accomplished by hinging the barrier strip to the glass plate via a piano hinge.

With reference now to FIGS. 13 and 14, a module 100 of the dispenser is illustrated. A forward module slot 102 located at the knob end of the module 100 engages a forward shelf slot, thereby holding the module 100 in position on the shelf 10. The module 100 can further include a rear module slot (not visible) which can engage a rear shelf slot. Therefore, the module 100 is secured and immovable on the shelf 10 from left to right, and also from front to back.

A top surface 106 of the module 100 includes a longitudinal slot 180 which runs over a majority of the length of the module. Mounted in the slot 180 is a trolley or pusher 170 which is engaged with the slot. The pusher 170 carries a coiled spring 190 which is secured in the slot 180. When the pusher 170 is urged towards the rear of the module 100, the coiled spring 190 unreels. This provides a force for biasing a column of packages (not shown) held on the module 100 in a forward direction. Such column of merchandise is held between a fixed stop plate or front fence 160 and the pusher plate 170. A side wall 200 located at one side edge of the module 100 can carry a flange 202. In one embodiment, the side wall 200 can be moved laterally so as to accommodate packaged items of various widths.

Each module 100 further includes an ejector mechanism so that packaged items supported on each of the modules may be dispensed independently of the other modules. To dispense the front packaged item or piece of merchandise in a column of such items held on the module 100, the knob 40 is rotated.

As the knob 40 is rotated, a shaft which is joined to and extends rearwardly from the knob causes a crank to move a moveable ejector plate 270 (FIG. 14) in a slot 290. The ejector plate 270 is caused to slide linearly upwardly towards the surface 106. The ejector plate 270 then moves through the slot 290 in the surface 106 of the module 100 and protrudes at its highest point above the fixed stop 160, so that the first packaged item, which is resting against the fixed stop 160, is pushed above it. When this happens, the spring bias exerted on the pusher plate 170 will urge any intervening packaged items forward on the module 100.

Rotation of the knob 40 continues so that the ejector plate 270 moves back down through the slot 290 into a position beneath the surface 106, thereby completing one ejection cycle. As the first packaged item and the ejector plate 270 are no longer present, the next packaged item is urged to move up against the fixed stop 160 by the pusher plate 170, and is therefore in a position to be ejected whenever the knob 40 is next rotated. One difficulty with this known system is that the ejector plate sometimes will move two adjacent products or items above the fixed stop and then both items are urged forwardly by the spring biased pusher 170. Thus, while a customer had only wanted to purchase one product, in reality two such products will be vended to the customer at the same time. It would be advantageous to provide an ejector mechanism which reduces the possibility of two packages being ejected simultaneously. Another problem with the known ejector mechanism is that sometimes drag of the product against the dispensing mechanism, for example against the fixed stop 160 or the product directly behind the product which is intended to be dispensed, makes it difficult to rotate the knob.

Figure 15:
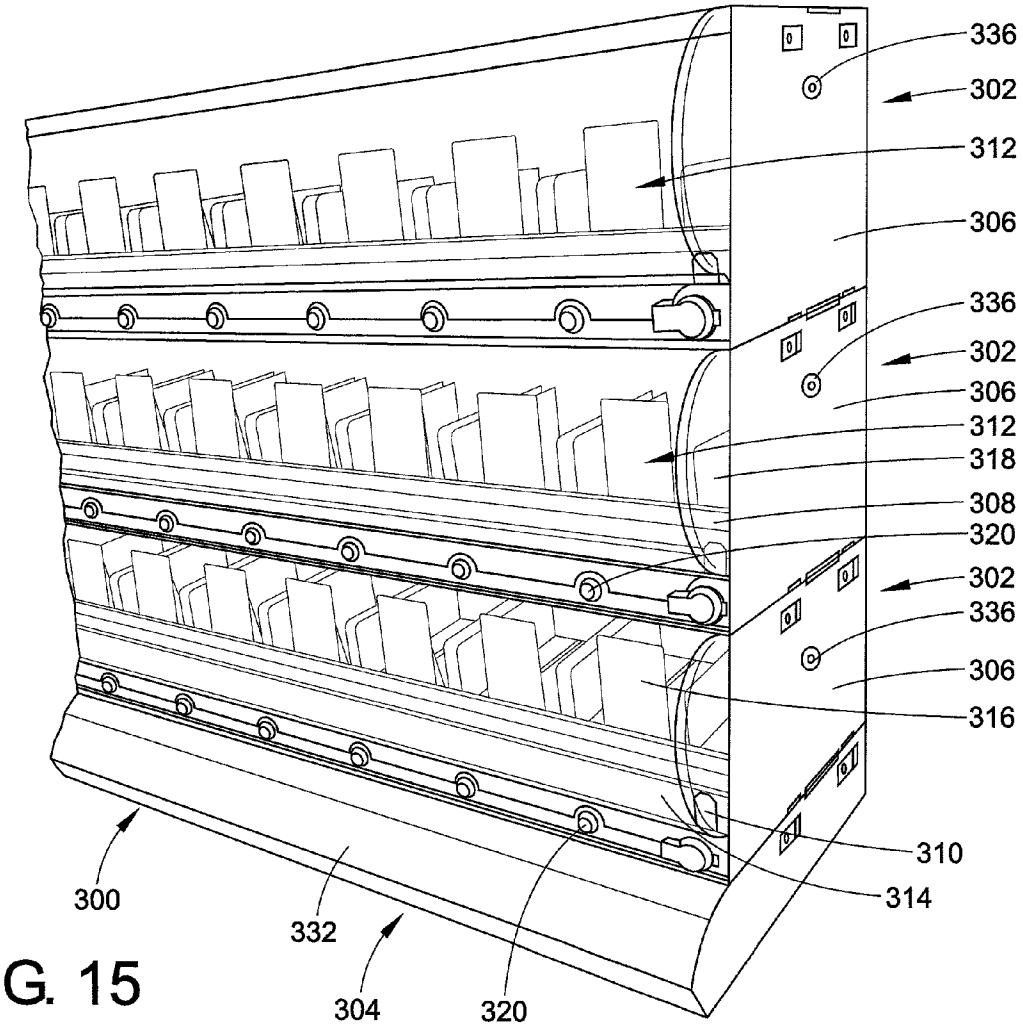
FIG. 15 is a perspective view of a dispenser system according to the present disclosure, the dispenser system including a plurality of dispensers vertically stacked upon each other.

With reference now to FIG. 15, a dispenser system 300, according to the present disclosure, includes one or more dispensers 302 stacked vertically upon a base 304. The dispensers 302 vend packaged items, such as packaged merchandise, with each dispenser capable of holding a plurality of packaged items. In the embodiment illustrated, the dispenser system 300 includes three such dispensers 302 stacked vertically upon the base 304. The dispensers 302 are secured to one another and to the base in a manner that prohibits a would-be thief from simply removing the dispensers from the stack. For example, the dispensers 302 can be screwed or bolted together. It should be appreciated that any number of such dispensers 302 could be mounted on a base 304.

While not necessary, the base 304 can include electronics for providing power to the dispensers 302. The base 304 can further include a central controller coordinating the vending or merchandising of the packaged items from the dispenser system 300. It should be appreciated that the base 304 includes an accessible portion or tray 332 from which items dispensed from the housing can be retrieved by a customer.

The dispensers 302 each include enclosures 306, such as a sheet metal box, and a storage shelf 308 mounted within the enclosure 306. The enclosure 306 surrounds the storage shelf 308 on all sides and further includes a front opening covered by a transparent window 310 of the dispenser. The shelf 308 is locked within the enclosure 306 so that packaged items loaded in the dispenser 302 are only accessible via a controlled dispensing system. The shelf 308 includes a plurality of tracks 312, each including a column of packaged items, positioned between a fixed front stop plate 314 and a pusher 316. To ensure that the column of products is maintained in good order on a track 312, one or more side walls 318 can be employed. The shelf 308 further includes a user input device 320 such as a push button which can be triggered so as to dispense a packaged item from the corresponding track. As mentioned, that item then is accessible to a customer at the tray 332 located at the front end of the base 304.

Figure 1:
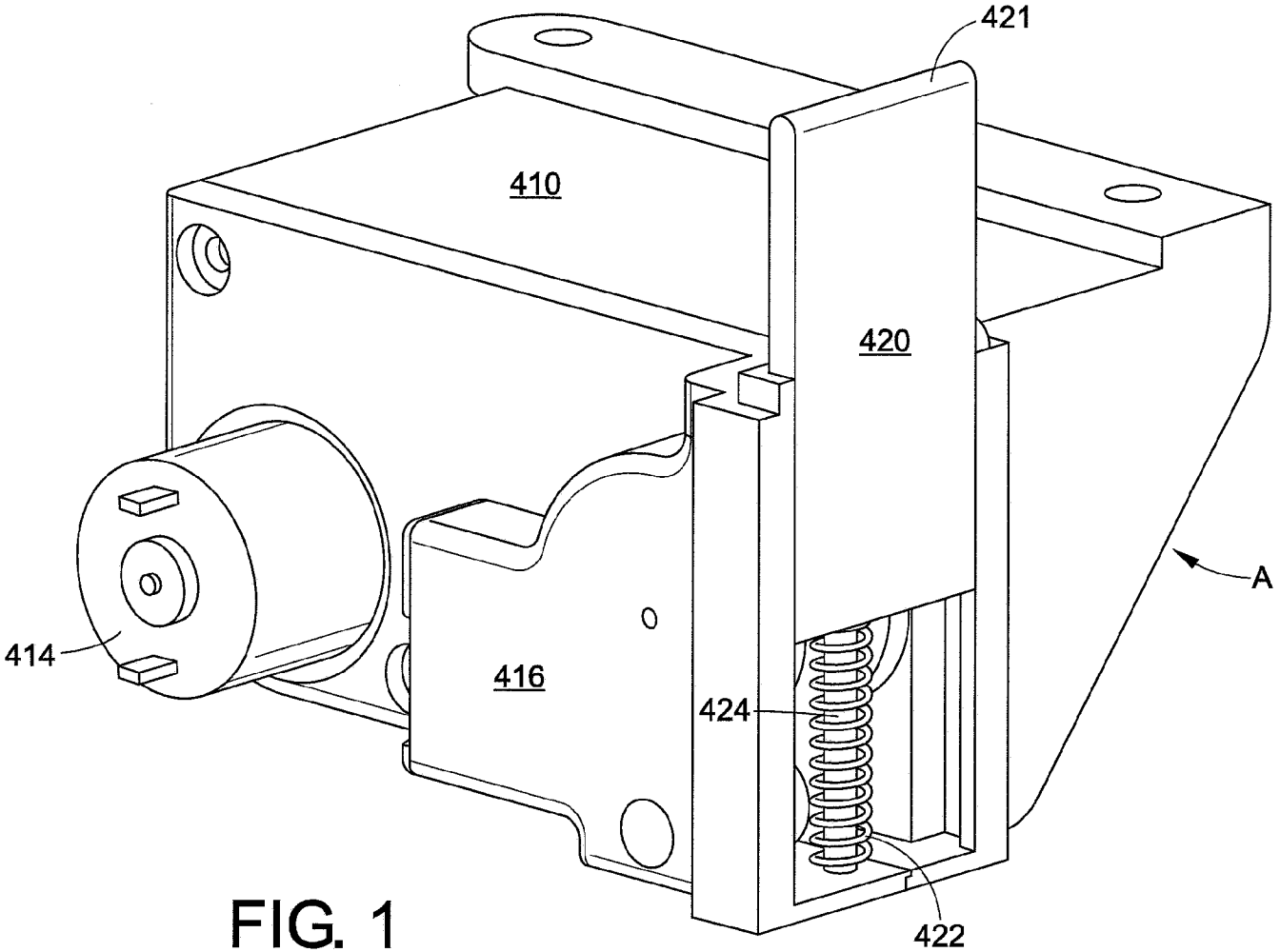
FIG. 1 is a perspective view of an ejector mechanism according to a first embodiment of the present disclosure.
Figure 2:
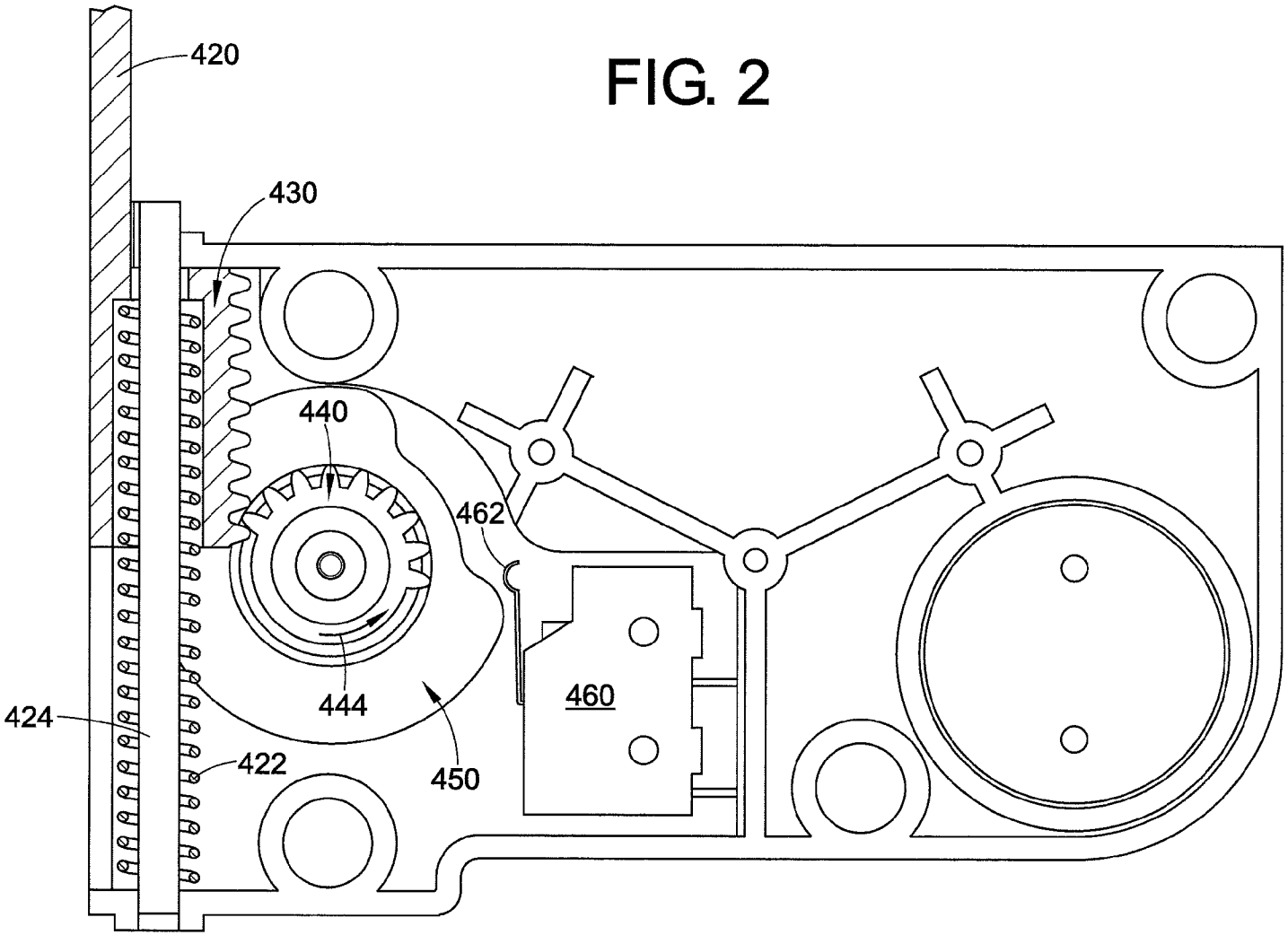
FIG. 2 is a side elevational view in cross section of the ejector mechanism of FIG. 1.
Figure 3:
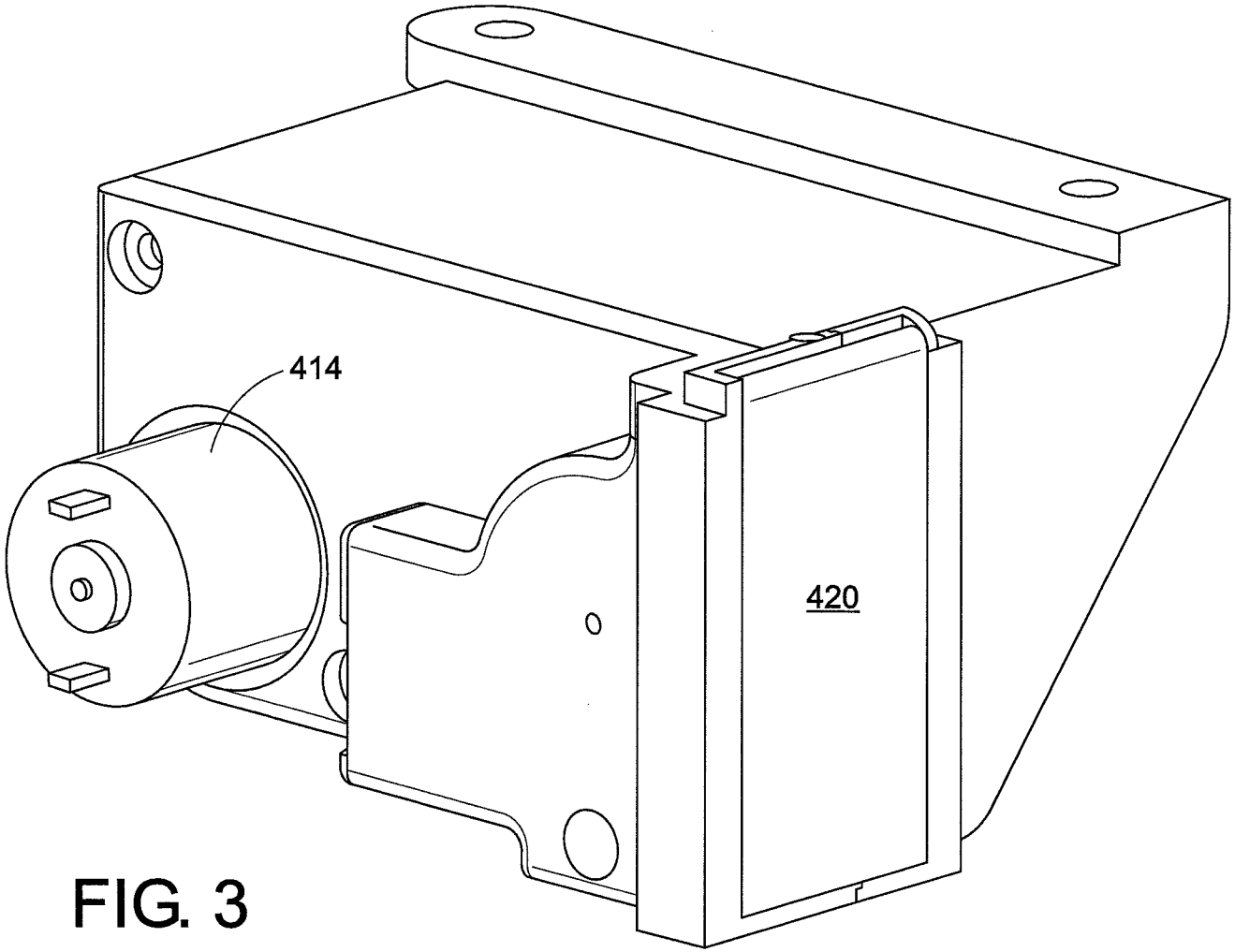
FIG. 3 is a perspective view of the ejector mechanism of FIG. 1 with an ejector plate being shown in a retracted position.
Figure 5:
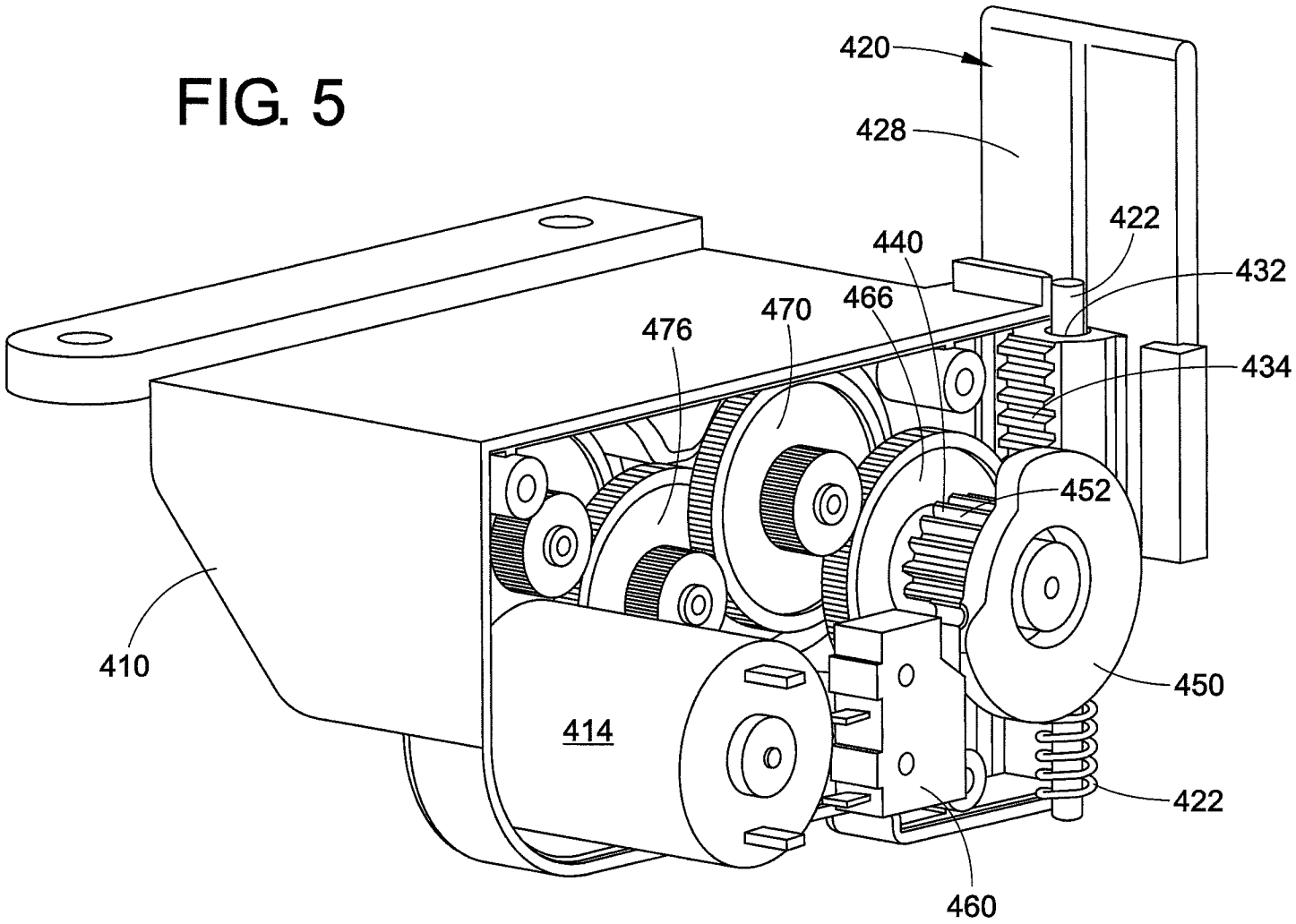
FIG. 5 is a perspective view of the ejector mechanism of FIG. 1 with a side wall removed for ease of understanding.

With reference now to FIG. 1, disclosed is an ejector mechanism A according to one embodiment of the present disclosure. The ejector mechanism includes a housing 410 and an end cap 412 from which protrudes a portion of an actuating member. In this embodiment, the actuating member can be an electric motor 414, such as a DC motor. Also disposed on the end cap is a cam housing 416. An ejector element, such as a rigid body in the form of a plate 420 in this embodiment is visible at one end of the housing 410. An upper end of the ejector plate 420 can be rounded as illustrated at 421. While an ejector element in the form of a plate, that is, a smooth, flat, thin, rigid body of generally uniform thickness is illustrated in the embodiment of FIG. 1, it should be appreciated that ejector elements having different shapes, thicknesses and surfaces are also contemplated. For example, the ejector element can have a varying thickness or a non-rectangular geometry, if so desired. A biasing member 422 is visible behind the ejector plate 420. In one embodiment, the biasing member 422 can be in the form of a spring. However, it should be appreciated that other types of resilient elements which can serve to bias the ejector element or plate 420 can also be employed. As mentioned, the biasing element can be a spring, such as a compression spring. The spring can be mounted on a post 424. With reference now also to FIG. 5, cooperating with spring 422 is an actuator which, in this embodiment, includes a rack 430. The rack can be secured to a rear face 428 of the ejector plate 420. It should be appreciated that the rack includes a bore 432 for accommodating the post 424. Disposed on the rack 430, are a plurality of linearly spaced teeth 434. Not visible in FIG. 5 is an upper end of the spring 422, which abuts a lower end of the rack 430. It is evident from FIG. 2 that the ejector element 420 includes a recessed area which accommodates a portion of the biasing member or spring 422. The recessed area is also visible in FIG. 5. In this way, the biasing member can urge the ejector element into an extended end position in which it is protruding from the housing 410, as also shown in FIG. 1. A retracted position of the ejector element 420 is illustrated in FIG. 3.

Figure 4:
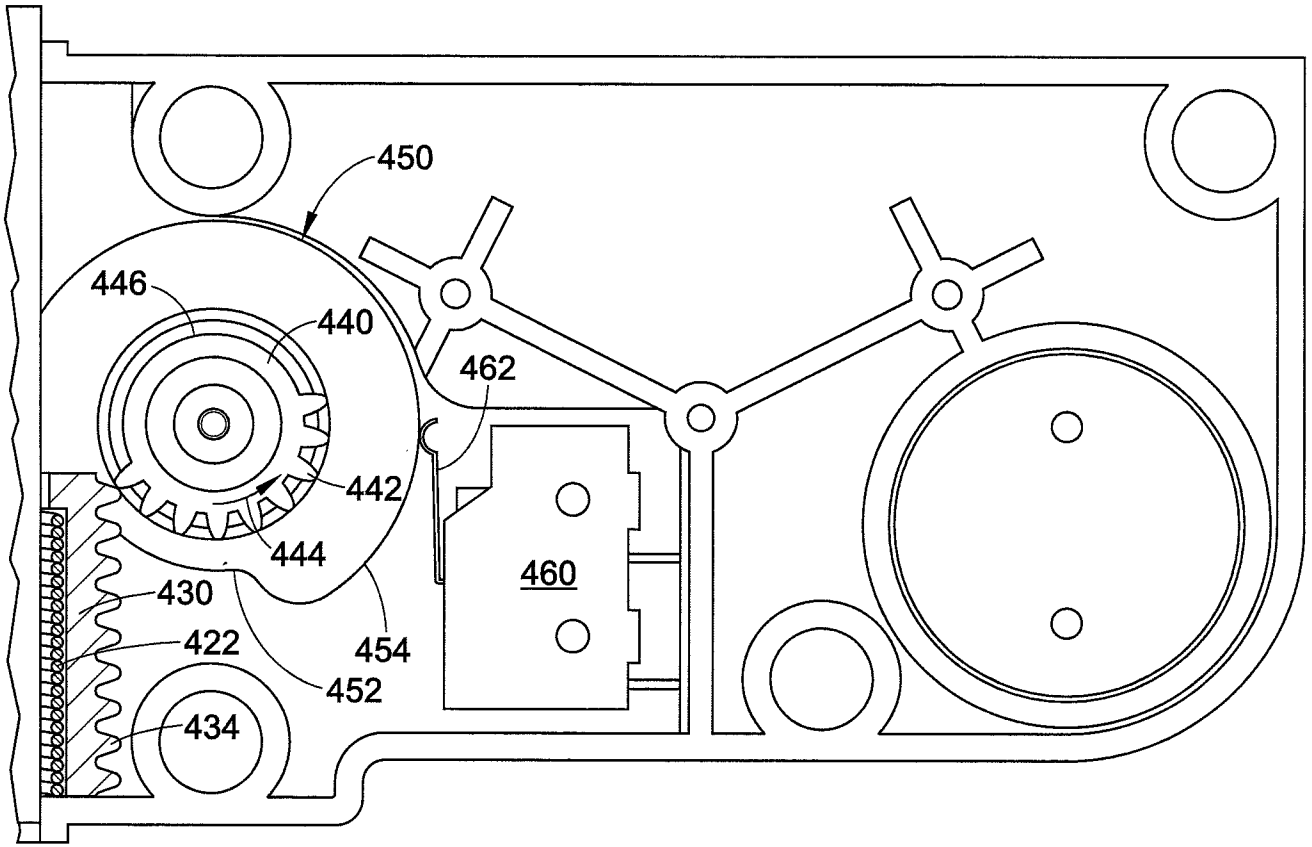
FIG. 4 is a side elevational view in cross section of the ejector mechanism of FIG. 3.

Also visible in FIG. 5 is another portion of the actuator. In this embodiment, it comprises a pinion 440 which includes teeth 442 that cooperate with the teeth 434 of the rack. As is well known in the art, a rack and pinion mechanism is a type of linear actuator which converts rotational motion into linear motion. The rotational motion applied to the pinion causes the rack to move, thereby translating the rotational motion of the pinion into the linear motion of the rack. With reference now also to FIG. 4, the pinion 440 has a direction of rotation illustrated by the arrow of 444. It should be appreciated that the teeth 442 are only located on approximately on half of the periphery of the pinion 440, the other half of the pinion, as at 446, does not have teeth. Instead, it has a reduced diameter section 446.

Connected to the pinion 440 is a plate cam 450, which includes an indented portion as at 452 located on an outer or camming surface 454 of the cam. The cam thus rotates in the same direction as does the pin in 440. Positioned adjacent the cam 450, is a solenoid 460 which includes a solenoid arm 462 that rides on the camming surface 454 of the cam. As the cam rotates in the direction of arrow 444, the solenoid arm 462 will eventually enter the indented portion of 452 of the cam. It should be appreciated that the cam 450 can be a plate type cam and that the solenoid arm 462 essentially serves as a follower, which moves in a plane perpendicular to the axis of rotation of the pinion. While a rack and pinion arrangement is illustrated in the embodiment of FIGS. 1-6, it should be appreciated that a variety of other types of actuators can also be employed.

Figure 6:
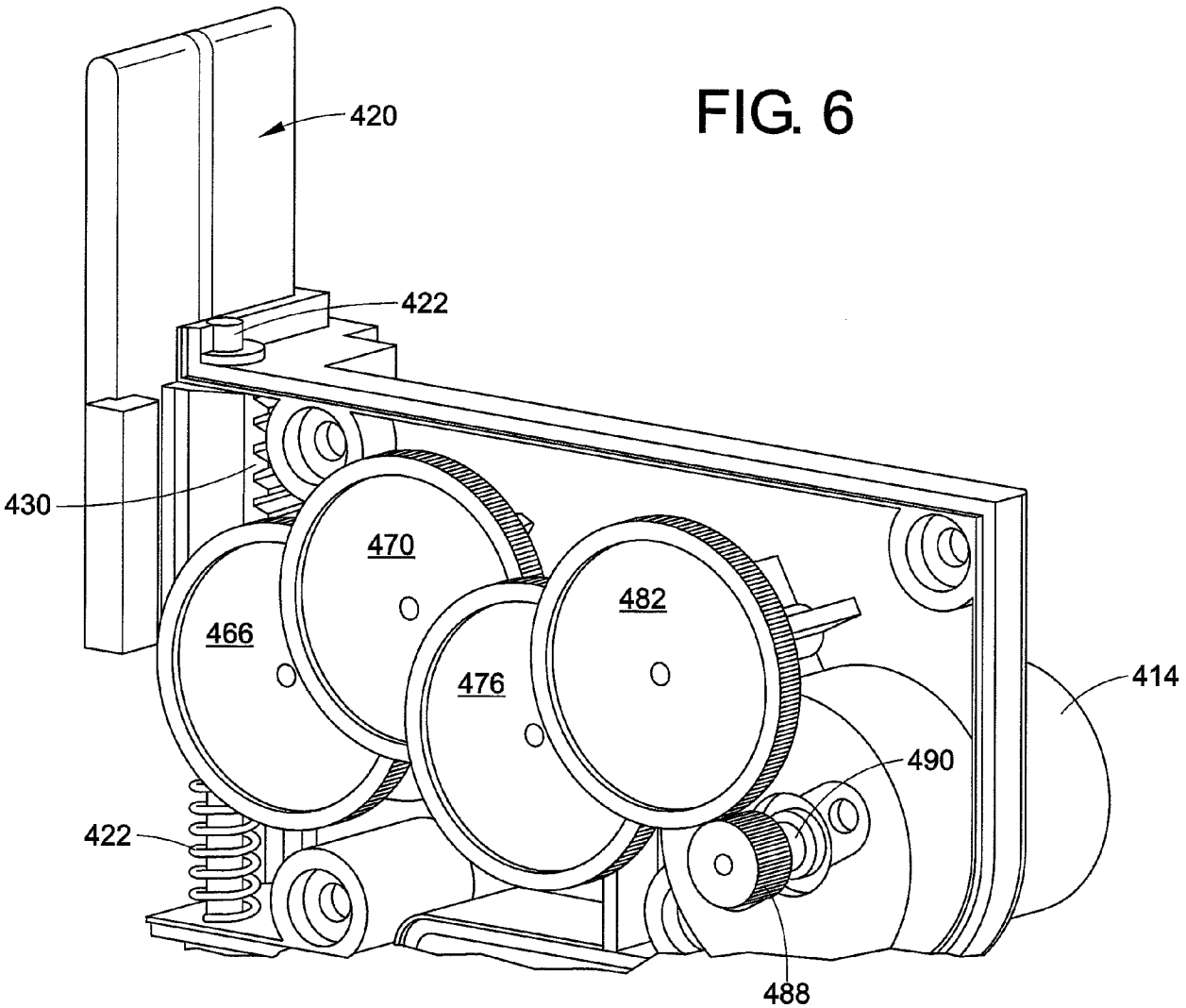
FIG. 6 is a perspective view of the ejector mechanism of FIG. 1 from the opposite side with a housing removed for ease of understanding.

With reference now to FIGS. 5 and 6, a gear train is provided in this embodiment for operably connecting the motor 414 to the pinion 440. In this embodiment of the gear train, there is provided a first gear 466 which rotates the pinion 440 and the cam 450. The first gear is in turn rotated by a first double gear 470, which is in turn rotated by a second double gear 476 that is in turn rotated by a third double gear 482. The third double gear is in turn driven by a drive gear 488 mounted on a drive shaft 490 of the motor 414. In this way, the speed of rotation of the motor drive shaft 490 can be reduced to a slower speed of movement for the pinion, and hence the rack 430. While a particular embodiment of a gear train is illustrated in FIGS. 5 and 6, it should be appreciated that a large variety of other types of gearing mechanisms can also be employed for the same purpose.

In use, when the button 320 on the vending shelf is depressed, it actuates the motor 414 which in turn drives the gear set or gear train 466, 470, 476, 782, and 488. The gear set in turn rotates the pinion 440. Rotation of the pinion moves the rack 430 in a downward position against the bias of the spring 422 from the extended position of the ejector plate 420 illustrated in FIG. 1, which is a first end position of the ejector plate to the retracted position illustrated in FIG. 3, which is a second end position of the ejector plate. In other words, the ejector plate 420 is there shown as being retracted. However, upon continued rotation of the pinion 440, the pinion teeth 442 become disengaged from the rack teeth 444. At this point, with the drive construction of the ejector mechanism no longer acting on the ejector element or plate, the biasing member or spring will ballistically move the ejector element upwardly towards its extended position as illustrated in FIG. 1.

Thus, the compressive force of the spring 422 is allowed to move the rack 430 in an upward direction. The power of the spring 422 overcomes the force of gravity, and because the rack 430 is connected to the ejector plate 420, the spring force moves the ejector plate 420 upwardly. The ejector plate 420 is thus allowed to fire upward under the force of the spring 422 to its extended or home position. Such movement of the ejector plate translates a static package held on the vending shelf and located directly above the formerly retracted ejector plate, into a dynamic state very quickly. Such rapid movement of the ejector plate 420, and hence the package residing directly above it when the ejector plate is in the retracted position, will minimize the effect of drag and friction between the first package in a column of packages and both the next adjacent package and the housing portions contacted by the first package. The first package is forcefully ejected upwardly and away from the column of remaining packages. One advantage of a planar ejector member, such as the plate 420, is that the ejector member is thin enough so as not to contact two adjacent packages in a column of packages at the same time. Rather, only the forward-most package will be contacted by the ejector element or plate, namely, the package residing directly above the plate. The first package can also be thrust forwardly somewhat and it then falls into the open area located in the vending mechanism illustrated in FIG. 15 in front of the several dispensers 302. By gravity, the package then falls down into the dispensing bin 332.

Power is supplied to the motor 414 even when a customer is no longer pressing the button 320 by the solenoid 460. However, when the solenoid arm 462 enters the indented portion 452 of the camming surface 454, power is shut off to the motor 414 by the solenoid 460. In this way, the motor only undergoes a limited time period of activation, enough for one complete rotation of the cam 450 and the pinion 440. This assures that the ejector plate 420 is only activated once for each push of the button 320. Preventing additional movement of the ejector plate 420 assures that only a single product will be dispensed upon the actuation of the button 320 one time.

Figure 7:
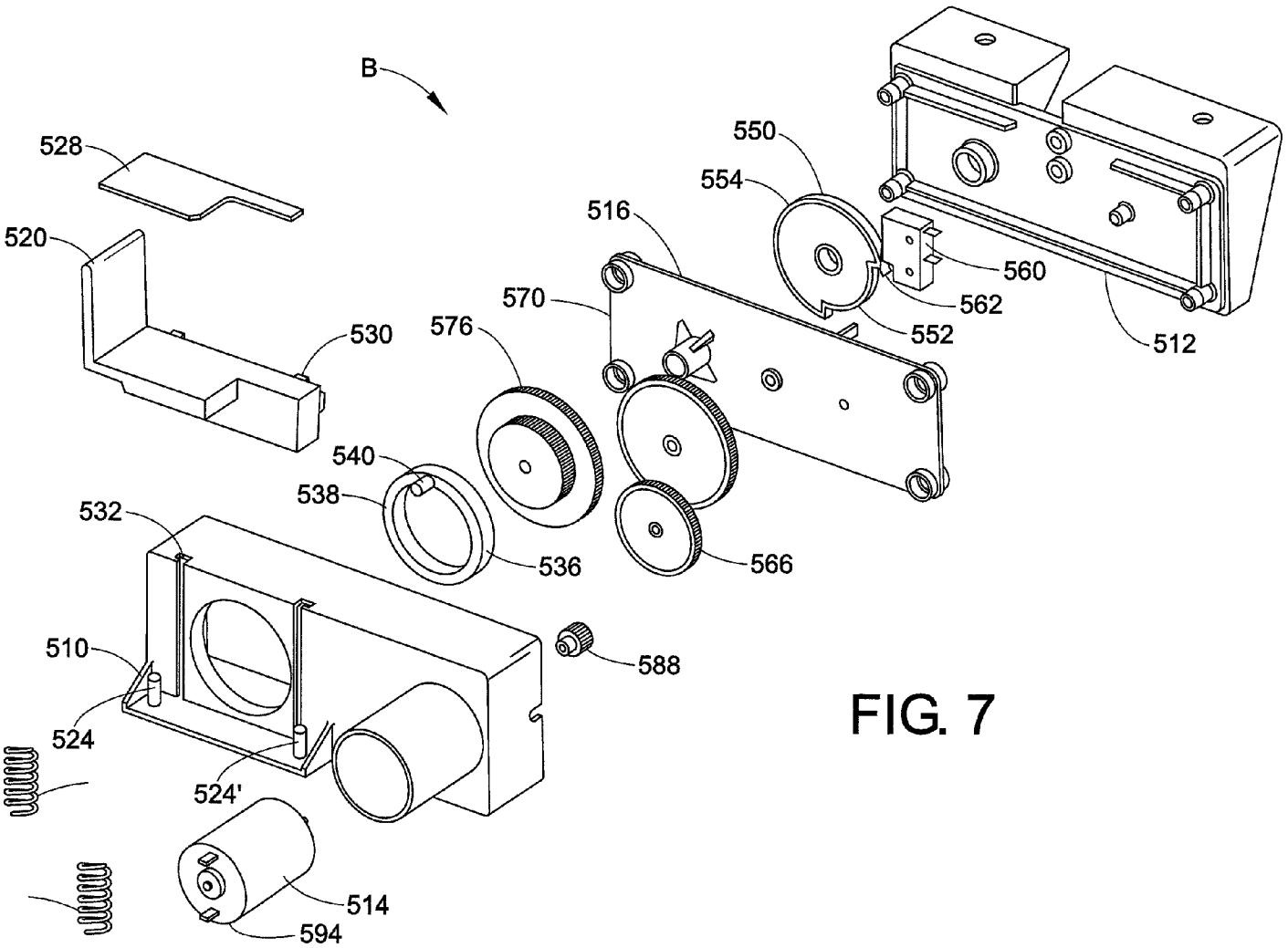
FIG. 7 is an exploded perspective view of a second embodiment of an ejector mechanism according to the present disclosure.

With reference now to FIGS. 7-11, disclosed is another embodiment of an ejector mechanism B, according to the present disclosure. In this embodiment, there is provided a housing 510 and an end cap 512. Protruding from the housing 510 is a portion of an actuating member. In this embodiment, the actuating member can comprise an electric motor 514. Disposed between the end cap 512 and the housing 510 is a center gear box plate 516. Selectively moveable in relation to the housing 510 is an ejector element 520. In this embodiment, the ejector element 520 is in the form of an L-shaped member, as is evident from FIG. 7. The L-shaped member can include a vertically extending somewhat rectangular portion, as well as a horizontally extending portion that includes a first rectangular section of a first width and a second rectangular section of a second, and narrower, width. Extending beneath the horizontally oriented portion is a further section of the ejector element 520. For the sake of simplicity, this entire assembly is termed "ejector plate." Also provided is a first spring 522, and defined on the housing is a post 524 which can accommodate one end of the spring. Also provided is a second spring 522' which is accommodated on a spaced second post 524'. Both posts are mounted on the housing 510, as best seen in FIG. 7.

In this embodiment, the horizontal portion of the ejector plate 520 can be provided with a foam pad 528. To guide movement of the ejector plate 520 in relation to the housing 510, there are provided one or more tabs 530 on the ejector plate which are adapted to move linearly in suitably shaped and positioned grooves 532 defined in the housing.

Figure 8:
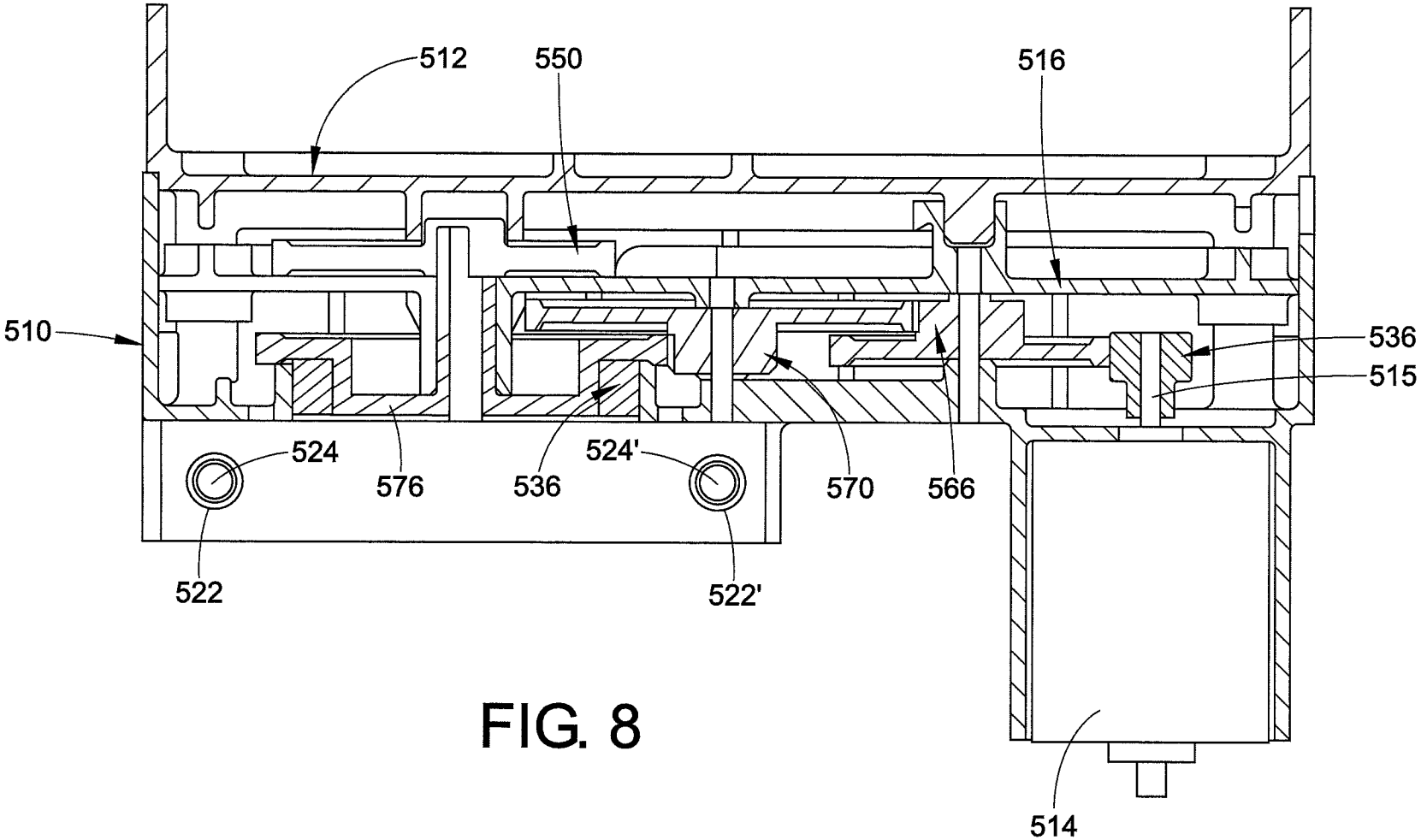
FIG. 8 is a top plan view in cross section of the mechanism of FIG. 7 in an assembled condition.

In this embodiment, the ejector mechanism includes an actuator in the form of adaptor ring 536. The adaptor ring comprises a ring portion 538 as well as a post portion 540. Also defined in the mechanism is a cam 550, which includes on its outer surface, an indented portion 552 located on an outer periphery 554. Cooperating with the cam 550 is a solenoid 560 which includes a moveable solenoid arm 562. A gear train connects an output shaft 515 of the motor 514 to the adaptor ring 536. In one embodiment, the gear train can comprise a first spur gear 566 which is provided with teeth on its outer periphery (not illustrated) that cooperates with a first double spur gear 570, which in turn cooperates with a second double spur gear 576, that in turn drives the adaptor ring 536. The first spur gear 566 is itself driven by a drive gear 588, mounted on drive shaft 513 of the motor 514, as best seen in FIG. 8.

Figure 9:
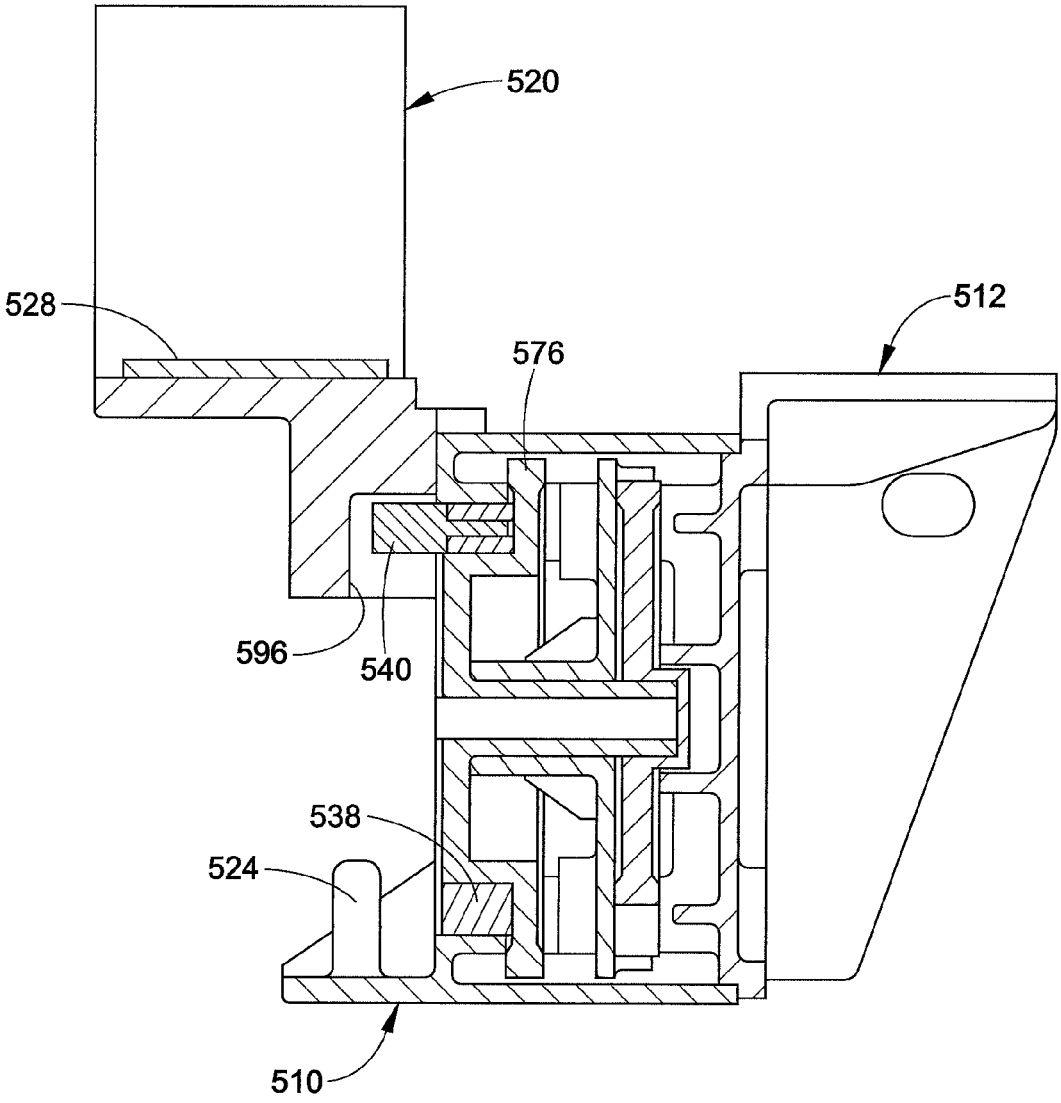
FIG. 9 is an end elevational view in cross section of the mechanism of FIG. 7 in an assembled condition, but in the absence of springs.
Figure 10:
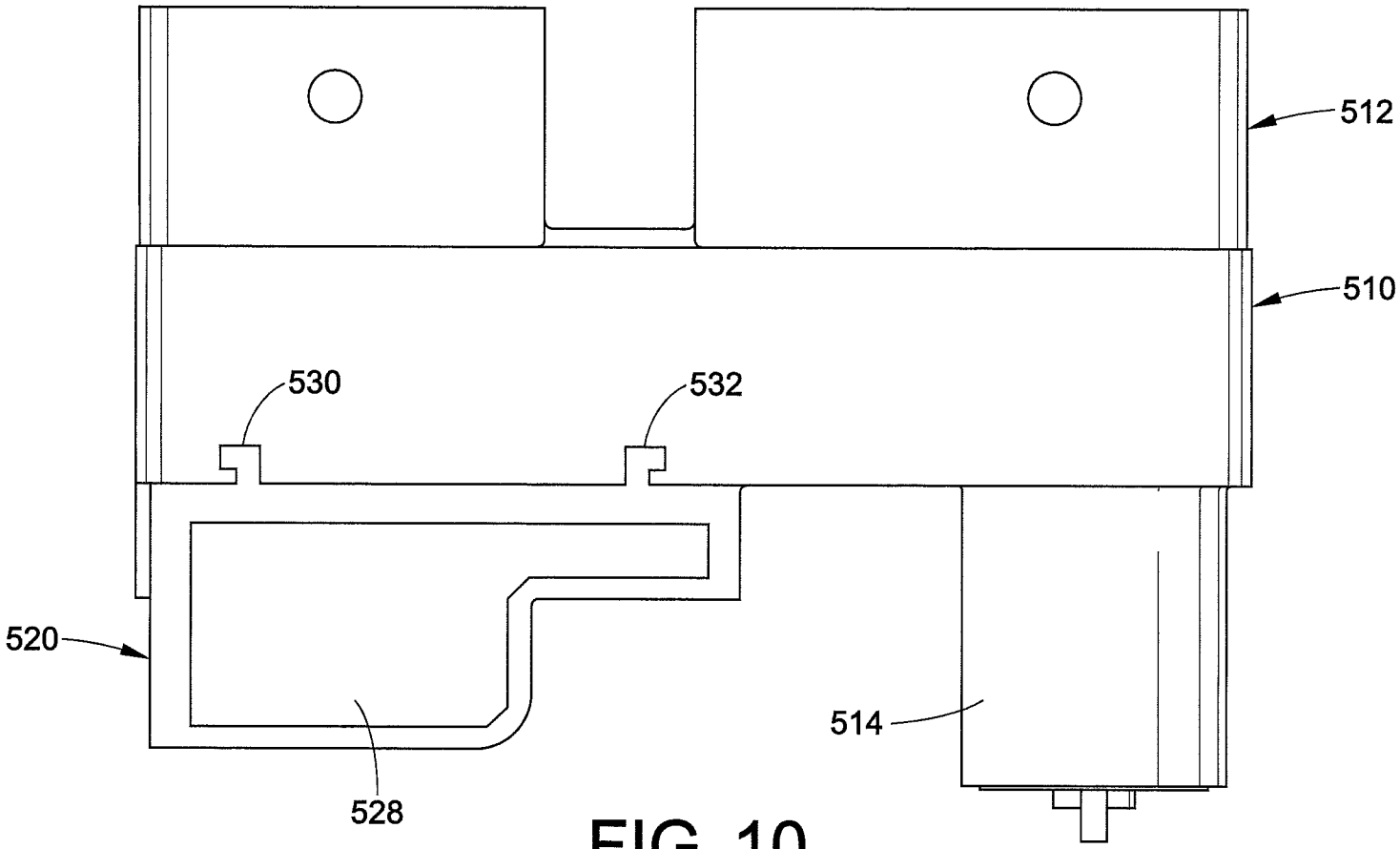
FIG. 10 is a top plan view of the mechanism of FIG. 7 in an assembled condition.
Figure 11:
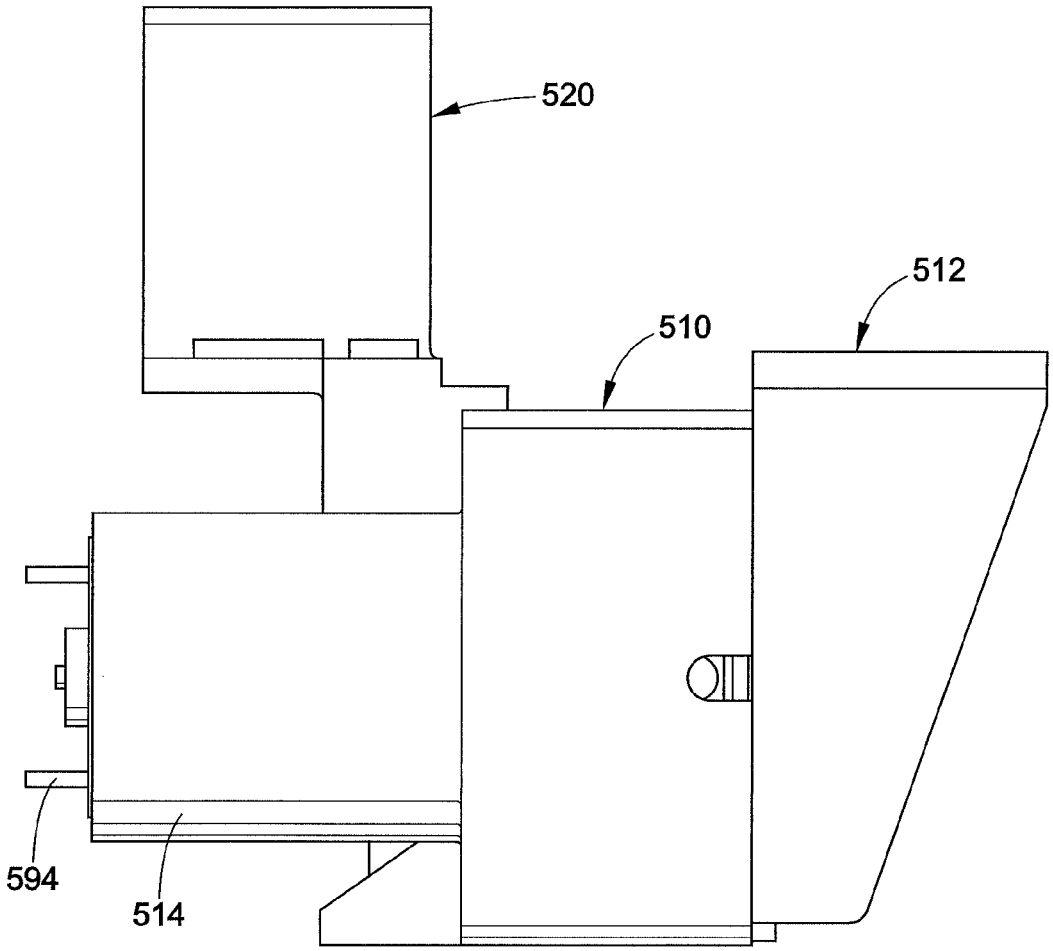
FIG. 11 is a rear end elevational view of the mechanism of FIG. 7 in an assembled condition.

When the button 320 on the vending shelf is depressed, it actuates the electric motor 514 which is connected to an electric circuit via leads 594. The gear set, 566, 570, 576, and 588 rotates the adaptor ring 536. As in the previous embodiment, the purpose of the gear train is to reduce the rotational speed of the motor shaft 513 to a desired speed for the adaptor ring 536. It should be appreciated that the adaptor ring 536 I connected to the second double spur gear 576. Also, the cam 550 which is located on the opposite side of the center gear box plate 516 from the second double spur gear 576, connected to the second double spur gear. As the adaptor ring 536 rotates clockwise, the adaptor ring post 540 rides in a channel 596 in the ejector plate 520, as best seen in FIG. 9. The rotating post pulls the ejector plate 520 down against the bias of the first spring 522 and the second spring 522', which as mentioned can be mounted on the posts 524 and 524' respectively on the main gear box housing 510. As the ejector plate moves down, it approaches an opening in the actuator channel that the adaptor ring post rides in. When the adaptor ring post enters the opening, it allows the actuator or ejector plate 520 to move upward under spring force to its home or extended position. Such movement of the ejector plate or actuator translates the previously static package or product located directly above the ejector plate 520 into a dynamic state as quickly as possible. This minimizes the effect of drag and friction between the package being dispensed and the next adjacent package of the set or column of packages as well as the drag and friction between the package being ejected and the surrounding portions of the housing contacted by that package. The operation of the motor 514 is controlled by the cam 550 and solenoid 560 as detailed above.

Figure 16:
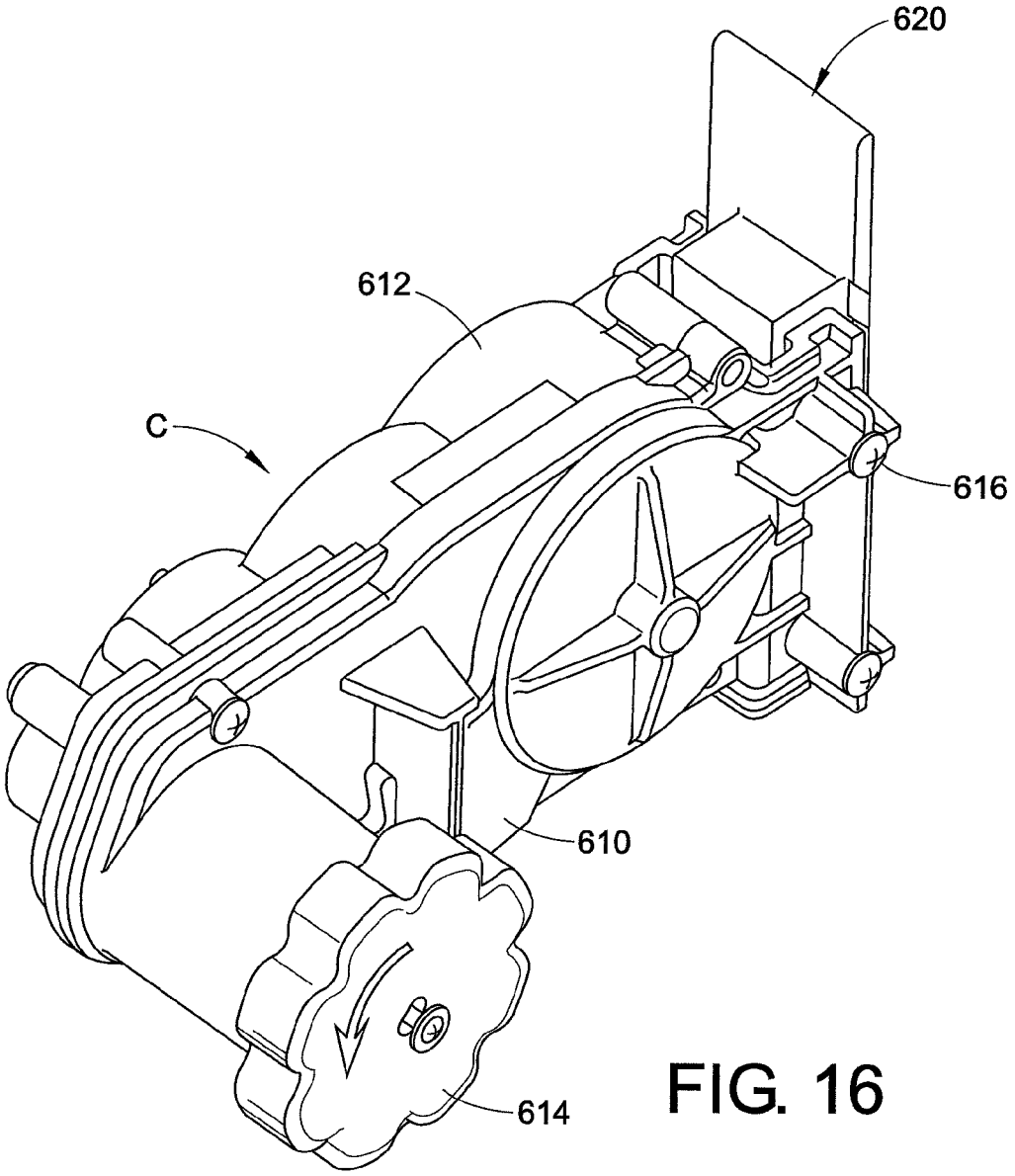
FIG. 16 is a perspective view of an ejector mechanism according to a third embodiment of the present disclosure.
Figure 17:
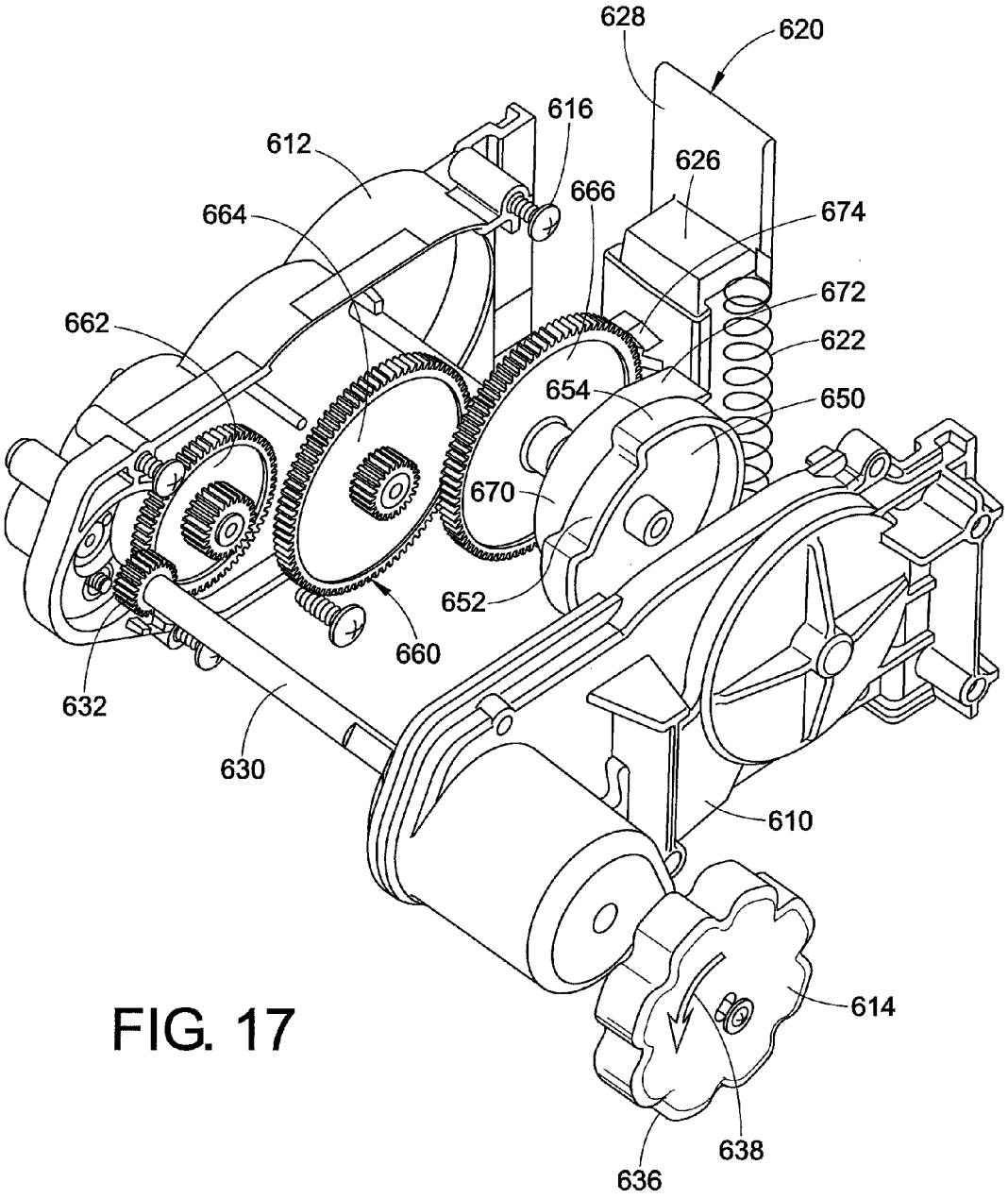
FIG. 17 is an exploded perspective view of the ejector mechanism of FIG. 16.

With reference now to FIG. 16, disclosed there is a further embodiment of an ejector mechanism according to the present disclosure. In this embodiment, an ejector mechanism C comprises a first housing section 610 and an end cap 612. Selectively actuating or operating the ejector mechanism in this embodiment is a knob 614. The housing and the end cap can be secured to each other via fasteners 616. An ejector plate 620 is located at one end of the mechanism C. With reference now also to FIG. 17, a spring 622 resiliently biases the ejector plate 620 into an extended position. The spring 622 may be supported on a post (not visible) and held in a housing 626 which can be defined on a rear face of the ejector plate 620. It should be apparent from FIG. 17 that the ejector plate 620 includes a portion 628 which extends above the top edge of the housing 626.

The knob 614 can be connected to a shaft 630 which can be provided on a distal end with a drive gear 632. It should be apparent from FIG. 17 that the knob 614 is provided with a scalloped outer periphery 636 to aid a potential customer in rotating the knob. A rotational direction of the knob 614 is indicated by an arrow 638 which can be embossed on a surface of the knob.

Selectively allowing actuation of the ejector plate 620 via the knob 614 can be a cam 650. In one embodiment, the cam includes an indented camming surface 652 located on an outer periphery 654 thereof.

A gear train 660 can cooperate with the drive gear 632 which is selectively rotated by the knob 614. In one embodiment, the gear train 660 can comprise a first gear 662 that is connected to a second gear 664 which, in turn, is connected to a third gear 666. One or more of these gears can be double gears. It should be appreciated that any suitable number of gears of any configuration can be employed as may be considered desirable to transmit the rotational action of the knob 614 to the mechanism which selectively allows the ejector plate to move as biased by the spring 622. The third gear 666 is, in turn, connected to a cam section 670 and cam 650 to selectively actuate movement of same. The cam section 670 includes a lobe 672 which cooperates with an extension ledge 674 of the ejector plate 620 to selectively allow the bias of the spring 622 to move the ejector plate 620 into its extended position without interference.

In one embodiment, rotational movement of the cam 650 as dictated by rotation of the gear train 660 actuated via the knob 614 will retract the ejector plate 620 from an extended position against the bias of the spring 622. Continued rotation of the gear train will then cause the cam lobe 672 to push the extension ledge 674 further downwardly until the cam lobe 672 clears the extension ledge 674. One the cam lobe 672 is disengaged from the extension ledge 674, the spring 622 is allowed to thrust the ejector plate 620 in an upright direction. When unfettered by the cam lobe 672, the ejector plate 620 is allowed to move upward under force of the biasing member 622 to its fully extended position. Such movement of the ejector plate translates a previously static package or product located directly above the ejector plate 620 into a dynamic state as quickly as possible. Thus, the first package is ejected quickly or with a short impulse. This is advantageous in order to minimize the transfer of kinetic energy to a second package positioned behind the first package, thus minimizing the effect of static inertia on the second package. In this way, the first package can be ballistically ejected from the column of packages positioned behind it. The first package can also be thrust forwardly somewhat and can then fall into the open area located in the vending mechanism illustrated in FIG. 15 in front of the several dispensers shown in that figure.

In this embodiment, a gear train 660 has been employed to communicate the rotation of the knob 614 to the cam 650 and the cam section 670. However, in another embodiment (not illustrated), the gear train 660 can be eliminated so that the rotation of the knob is directly transmitted to the cam. It should be appreciated that if the gear train was omitted, the knob could be mounted coaxially and coupled directly to the cam. However, one benefit of providing the gear train is to provide a mechanical advantage to reduce the torque required to rotate the knob. Another advantage would be to increase the amount of knob rotations it takes to cause the system to eject a product from a housing. This may be useful to slow down the rate at which packages or products could be dispensed from the housing. This would deter potential thieves from being able to dispense too many products too quickly from the housing.

Figure 18:
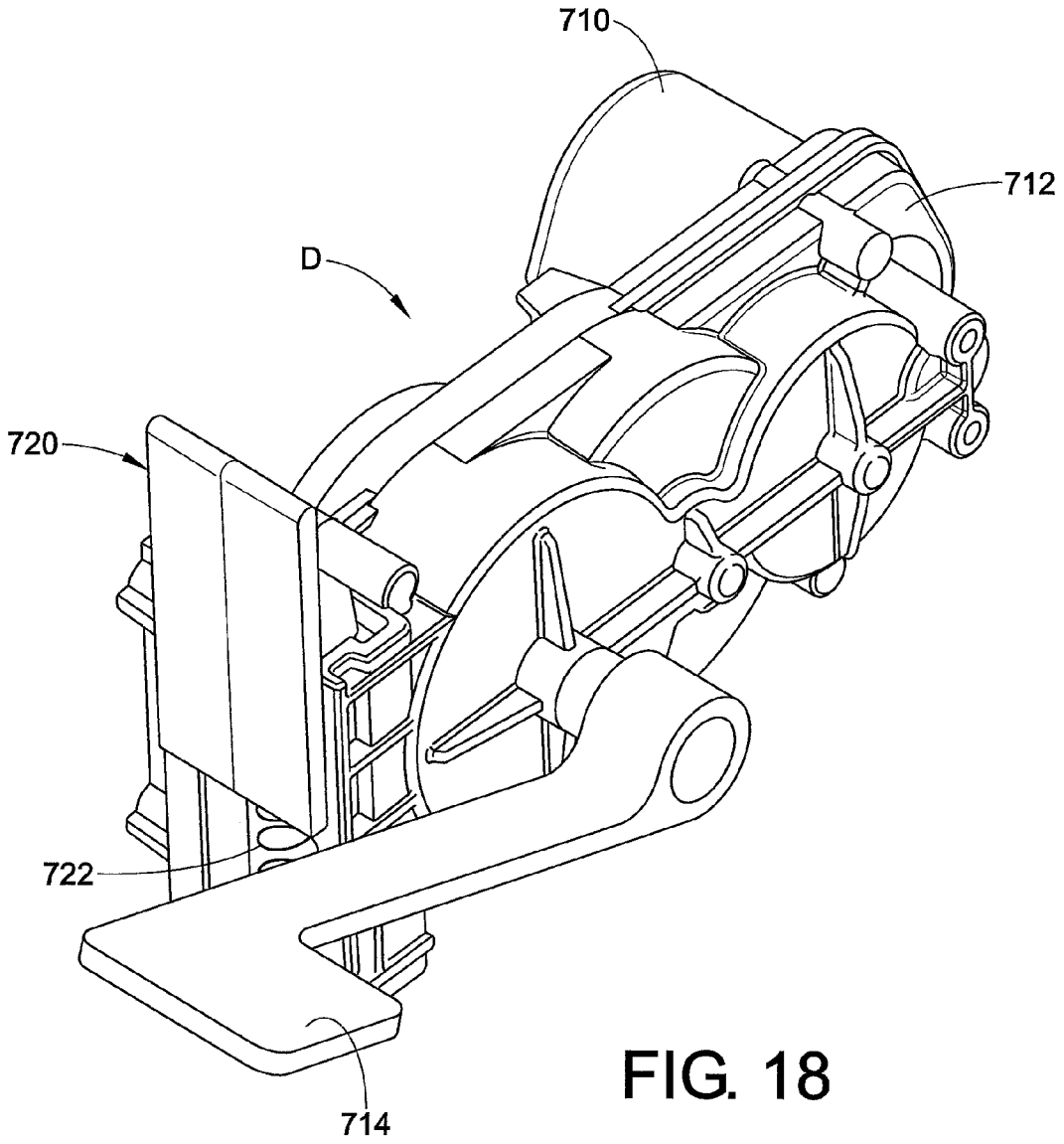
FIG. 18 is a perspective view of an ejector mechanism according to a fourth embodiment of the present disclosure.
Figure 19:
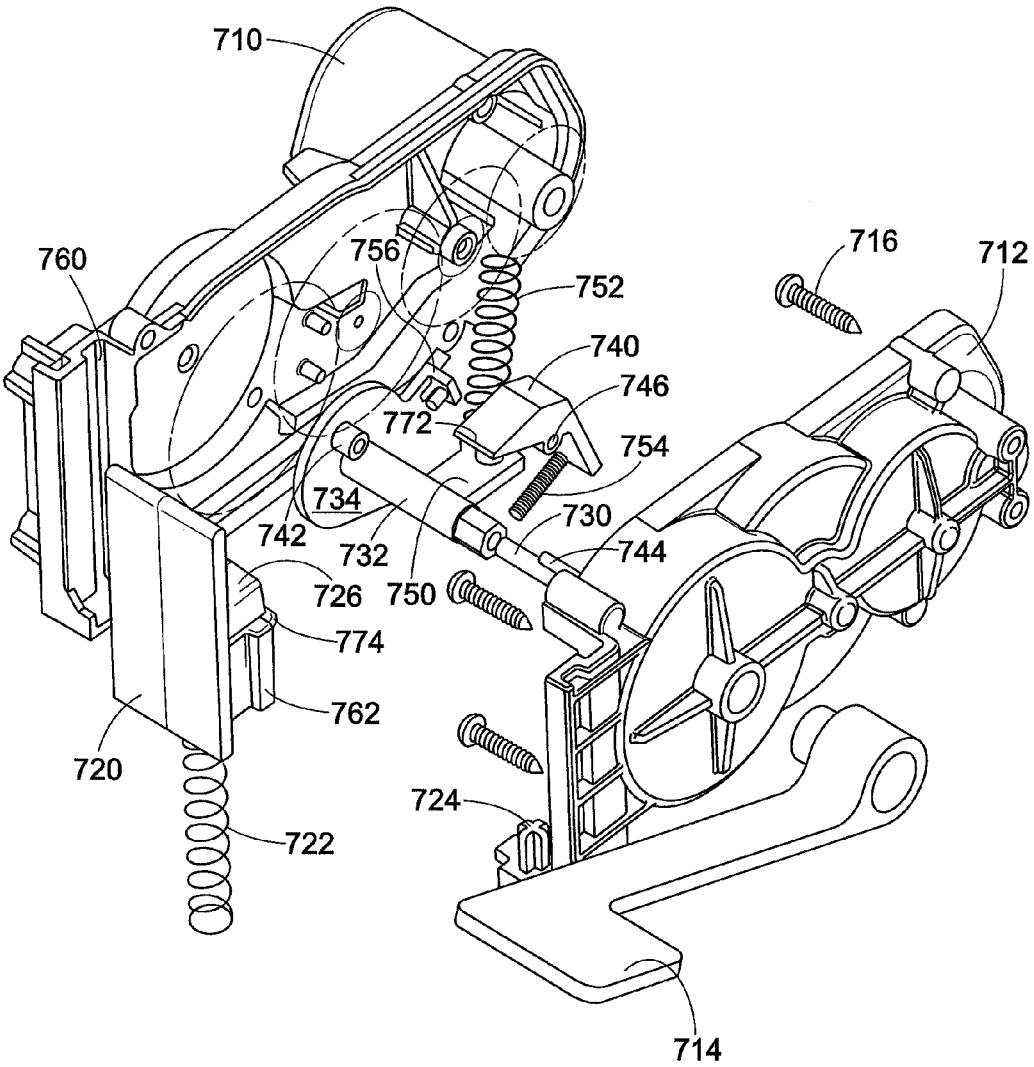
FIG. 19 is an exploded perspective view of the ejector mechanism of FIG. 18.

With reference now to FIG. 18, disclosed therein is a yet further embodiment of an ejector mechanism D according to the present disclosure. In this embodiment, the ejector mechanism comprises a housing 710 to which is secured an end cap 714. In this embodiment, actuation of the ejector mechanism is accomplished via a lever 714. It should be appreciated that suitable fasteners 716 (see FIG. 19) can be employed to secure the housing 710 and the end cap 712 to each other. The ejector mechanism B comprises an ejector plate 720 which is resiliently biased by a biasing element or member, such as a compression spring or first spring 722. With reference now also to FIG. 19, a bottom end of the first spring 722 can be positioned on a post 724 which can be defined on the end cap 712, if so desired. A top portion of the first spring 722 can be accommodated in a housing 726 which can be defined on a rear face of the ejector plate 720.

In this embodiment, a shaft 730 is mounted to a distal end of the lever 714. The shaft 730 cooperates with a post 732 which extends laterally from a pivot plate 734 that is rotatably mounted to at least one of the housing 710 and the end cap 712. Cooperating with the pivot plate 734 is a generally L-shaped member which can be termed a cam 740. In this embodiment, the cam 740 is pivotally mounted to the pivot plate 734 via a boss 742 extending from the pivot plate. A shaft 744 can extend from the end cap 712 and protrude through a bore 746 so as to enter the boss 742 thereby mounting the cam 746 to the pivot plate 734. Defined on the pivot plate 734 is a ledge 750 which accommodates a bottom end of a second spring 752. A third spring 754 can bias the cam 740. The third spring can be mounted on a flange 756 extending from the pivot plate 734.

The operation of this embodiment is as follows. A potential purchaser would push lever 714 down. Such movement will retract the ejector plate 720 from its extended position to a retracted position, as a first end 772 of the cam acts on the flange 774 located on the rear face of the housing 726. Further rotation of the lever arm 714 causes the cam first end 772 to slide past the flange 774 of the ejector plate that it was pushing on. As it is now, unconstrained, the ejector plate 720 is allowed to move rapidly upward due to the force of the compressed first spring 722. When lever arm 714 is released, the second spring 752 rotates the lever arm mechanism back to its original position. The third spring 754 allows the cam 740 to rotate out of the way of the ejector plate surface or flange 774 that the cam pushes down on during operation. The system is now reset and ready to repeat the sequence for the next dispensing action.

In one embodiment, the ejector plate 720 is mounted to the housing 710 and end cap 720 which are secured together. Movement of the ejector plate is accommodated via suitable grooves 760 located in each of the housing and the end cap. These grooves cooperate with suitable ribs 762 which extend laterally from the housing 726 mounted to the ejector plate 720. In this way, the ejector plate is allowed to reciprocate linearly up and down in relation to a column of packages held on a support surface located above the ejector mechanism D.

The lever 714 is biased to an end position, normally an up position, via the second spring 742. Actuation of lever 714 by pushing down on its proximal end, against the bias of the second spring 742, will rotate the lever and, hence, rotate the shaft 730 attached to the distal end of the lever. Such rotation will be communicated to the post 732 and, hence, the pivot plate 734. This then allows the cam 740 to move in such a way that a first end 772 thereof disengages from a flange 774 defined on the housing 726.

Thus, when the lever 714 is pressed, the cam 740 is eventually disengaged from the ejector plate 720 allowing the bias of spring 722 to shoot the ejector plate 720 upwards as dictated by the engagement of the rib 762 with a groove 760. As a result, the package located immediately above the ejector plate will be ejected with a short impulse so as to minimize the transfer of kinetic energy to a second package located directly behind the first package. The movement of the ejector plate thus minimizes the effect of static inertia on the second package by rapidly ejecting the first package from the column of packages held on a support surface located above the ejector mechanism D.

Disclosed has been a transport mechanism for moving an article such as a forwardmost package or product in a column of products or packages supported on a generally horizontally oriented support surface located in a housing of a merchandising device away from the rest of the column so that the product can be dispensed from the housing as dictated by a customer of the merchant. To this end, there is provided a moveable plate held in the housing which is adapted for contacting a portion of the package, such as a bottom surface thereof. The moveable plate is biased to an extended position by a biasing member such as a spring. However, the moveable plate can be retracted to a retracted position by an actuator or operator. In one embodiment, an actuator mechanism is operably connected to both an actuating member and the plate. In one embodiment, the actuating member can comprise an electric motor. In another embodiment, the actuating member can comprise a knob. In still a further embodiment, the actuating member can comprise a lever. The actuator mechanism then acts to retract the ejector plate against the bias of the spring to a second (or retracted) end position. When the ejector plate is retracted, a pusher or gravity feed urges the forward most package in a column of packages or products forward on the shelf or support surface so that it contacts a front restraint member, such as a front fence or product stop (such as product stop 160 in FIG. 14). At this point, the top face of the ejector plate is located directly beneath the package which is meant to be ejected at the request of the customer.

In one embodiment, when a customer presses a button on the housing to actuate a motor, the actuator mechanism then disengages a drive construction from the ejector plate and allows a spring to move the plate rapidly upwards thereby thrusting the package in a ballistic manner away from the remaining packages in the column held in the housing. In another embodiment, a customer rotates a knob to retract the ejector plate and eventually disengage a mechanism which prevents the ejector plate from being subject to the bias of the spring. In still another embodiment, a lever can be employed to retract the ejector plate and eventually disengage a mechanism which prevents actuation of the ejector plate.

Further disclosed has been an ejector mechanism for dispensing one item at a time from a housing. The mechanism in one embodiment includes an electromechanical ejector which is resiliently biased so as to translate a static package into a dynamic state as quickly as possible, i.e., in a short impulse, thereby minimizing the effect of drag and/or friction between adjacent packages and/or portions of the housing adjacent the package being dispensed. The quick movement of the ejector plate minimizes the transfer of kinetic energy to a second package located behind the first package. This minimizes the effect of static inertia on the second package. In another embodiment, a purely mechanical ejector assembly is provided for performing the same function. In one embodiment, a purely mechanical ejector assembly having a first configuration is operated by a knob. In another embodiment, a mechanical ejector assembly having a second configuration is operated by a lever.

Also disclosed has been a transport mechanism for moving an associated article away from a stack or column of such articles which are supported in a housing. The transport mechanism comprises a moveable ejector member held in the housing and adapted for contacting a face of the associated article. A biasing member contacts a portion of the ejector member and is adapted to bias the ejector member to a first end position or extended position. In one embodiment, a drive construction is operably connected to both an actuating member and the plate for selectively moving the plate. The actuating member, which can, for example, comprise a motor, can move the plate to a second end position or retracted position against the bias of the biasing member. In other embodiments, a mechanical assembly is operably connected to both an actuating member and the plate for selectively moving the plate. In one embodiment, the operator of one type of mechanical assembly can be a knob. In another embodiment, the operator of another type of mechanical assembly can be a lever. The mechanical assemblies can move the plate to a second end position or retracted position against the bias of the biasing member.

The disclosure has been described with reference to several embodiments. Obviously, modifications and alterations will occur to others upon the reading and understanding of the preceding detailed description. It is intended that the instant disclosure be construed as including all such modifications and alterations insofar as they come with the scope of the appended claims or the equivalents thereof.

The invention claimed is:

1. An ejector mechanism for moving a forwardmost associated article away from a stack or column of such articles, the forwardmost article having a surface supported on a support surface, the ejector mechanism comprising:

an ejector housing;

a selectively moveable ejector element mounted to the ejector housing and located adjacent the support surface, wherein a surface of the ejector element is adapted for contacting the surface of the forwardmost associated article and moving upwardly relative to the support surface for moving the surface of the forwardmost associated article vertically away from the support surface;

a resilient biasing member which acts on the ejector element, the biasing member being mounted to the ejector housing and being adapted to bias the ejector element vertically in a direction transverse to the support surface to a first end position in relation to the support surface;

an actuating member operably connected to the ejector element; and an electromechanical or mechanical assembly operably connected to both the actuating member and the ejector element and adapted to selectively move the ejector element to a second end position in relation to the support surface against the bias of the biasing member.

2. The mechanism of claim 1 wherein the electromechanical or mechanical assembly includes a speed reducing gear train.

3. The mechanism of claim 2 wherein the actuating member comprises a motor and the mechanism further includes a spur gear connected to an output shaft of the motor, the spur gear engaging a gear of the speed reducing gear train.

4. The mechanism of claim 1 wherein the electromechanical or mechanical assembly includes an operator adapted to selectively disengage the assembly from the ejector element and allow the biasing member to act freely on the ejector element.

5. The mechanism of claim 4 wherein the operator includes a rack and pinion construction or a cam.

6. The mechanism of claim 4 wherein the operator includes an adaptor ring on which is positioned a post, wherein the post cooperates with the selectively moveable ejector element.

7. The mechanism of claim 1 wherein the actuating member comprises a motor and further comprising a motor control circuit for selectively powering the motor, wherein the motor control circuit includes a switch for selectively actuating the motor.

8. The mechanism of claim 7 wherein the motor control circuit further includes a cam and a solenoid including a protruding arm which cooperates with the cam for deactivating the motor when the arm enters a recessed portion of the cam.

9. The mechanism of claim 1 wherein the actuating member comprises one of a knob and a lever.

10. An ejector mechanism for ballistically moving a forwardmost associated article away from a stack or column of such articles supported on a generally horizontally oriented surface located in an outer housing, the forwardmost article having a surface supported on the generally horizontally oriented surface, the ejector mechanism comprising:

an ejector housing:

a selectively moveable plate held in the housing and mounted to the ejector housing, the plate including a surface adapted for contacting the surface of the forwardmost associated article and moving upwardly relative to the generally horizontally oriented surface for moving the surface of the forwardmost associated article vertically away from the generally horizontally oriented surface;

a spring mounted to the ejector housing and acting on the plate and adapted to bias the plate vertically in a direction transverse to the generally horizontally oriented surface to an extended position in relation to the generally horizontally oriented surface;

an actuating member operably connected to the plate and acted on by the spring; and, an electromechanical or mechanical assembly operably connected to both the actuating member and the plate and adapted to selectively move the plate, against a bias of the spring, to a retracted position in relation to the generally horizontally oriented surface.

11. The mechanism of claim 10 wherein the electromechanical or mechanical assembly includes:

a speed reducing gear train; and a spur gear connected to an output shaft of the actuating member and engaging a gear of the speed reducing gear train.

12. The mechanism of claim 11 wherein the electromechanical or mechanical assembly further includes an operator adapted to selectively disengage the assembly from the plate and allow the spring to act freely on the plate.

13. The mechanism of claim 12 wherein the operator includes at least one of a rack and pinion construction, an adaptor ring on which is positioned a post, wherein the post cooperates with the moveable plate, or a cam.

14. The mechanism of claim 10 wherein the actuating member comprises one of a knob and a lever.

15. The mechanism of claim 10 wherein the actuating member comprises a motor and further comprising a motor control circuit including a cam and a solenoid including a protruding arm which cooperates with the cam for deactivating the motor when the arm enters a recessed portion of the cam.

16. An ejector mechanism employed in a merchandising environment for ballistically moving an associated article away from a stack or column of such articles supported on a shelf extending in a generally horizontal direction, the ejector mechanism comprising:

an ejector housing;

a plate mounted to the ejector housing and selectively moveable in a vertical direction in relation to a horizontally oriented merchandising shelf, the plate including a surface adapted for contacting a surface of the associated article and moving upwardly relative to the shelf for moving the associated article vertically away from the stack or column of such articles in a direction transverse to the horizontal direction;

a spring mounted to the ejector housing and acting on the plate and adapted to bias the plate vertically in a direction transverse to the horizontal direction to an extended position in relation to the shelf;

an actuating member which contacts the spring and is operably connected to the plate; and, an electromechanical or mechanical assembly operably connected to the actuating member so as to a) allow the spring to bias the plate to its vertically extended position in relation to the shelf, and b) subsequently move the plate, against a bias of the spring, to a vertically retracted position in relation to the shelf so that the plate surface is located adjacent a top surface of the shelf.

17. The mechanism of claim 16 wherein the electromechanical or mechanical assembly further includes an operator adapted to selectively disengage the assembly from the plate and allow the spring to act freely on the plate.

18. The mechanism of claim 17 wherein the operator includes at least one of a rack and pinion construction, an adaptor ring on which is positioned a post, wherein the post cooperates with the plate, or a cam.

19. The mechanism of claim 16 wherein the electromechanical or mechanical assembly includes:

a speed reducing gear train; and a spur gear connected to an output shaft of the actuating member and engaging a gear of the speed reducing gear train.

20. The mechanism of claim 16 wherein the actuating member comprises a motor and further comprising a motor control circuit including a cam and a solenoid including a protruding arm which cooperates with the cam for deactivating the motor when the arm enters a recessed portion of the cam.

21. The mechanism of claim 1 wherein the ejector element is configured to move the forwardmost associated article away from the stack or column of such articles supported on the support surface in a short impulse so as to minimize a transfer of kinetic energy to a second associated article engaging the forwardmost article.

22. The mechanism of claim 10 wherein the plate is configured to move the forwardmost associated article away from the stack or column of such articles supported on the support surface in a short impulse so as to minimize a transfer of kinetic energy to a second associated article engaging the forwardmost article.

23. The mechanism of claim 16 wherein the plate is configured to move the associated article away from the stack or column of such articles supported on the shelf in a short impulse so as to minimize a transfer of kinetic energy to a second associated article engaging the associated article.

* * * * *